US009776425B2

(12) United States Patent
Kyoso

(10) Patent No.: US 9,776,425 B2
(45) Date of Patent: Oct. 3, 2017

(54) INKJET PRINT DEVICE AND INKJET HEAD EJECTION PERFORMANCE EVALUATION METHOD

(71) Applicant: FUJIFILM Corporation, Tokyo (JP)

(72) Inventor: Tadashi Kyoso, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/355,006

(22) Filed: Nov. 17, 2016

(65) Prior Publication Data

US 2017/0144463 A1 May 25, 2017

(30) Foreign Application Priority Data

Nov. 19, 2015 (JP) ..... 2015-226405

(51) Int. Cl.

| | |
|---|---|
| ***B41J 2/21*** | (2006.01) |
| ***B41J 2/045*** | (2006.01) |
| ***B41J 29/393*** | (2006.01) |
| ***B41J 2/01*** | (2006.01) |

(52) U.S. Cl.

CPC ..... *B41J 2/2132* (2013.01); *B41J 2/01* (2013.01); *B41J 2/04543* (2013.01); *B41J 2/04558* (2013.01); *B41J 2/2139* (2013.01); *B41J 2/2142* (2013.01); *B41J 29/393* (2013.01); *B41J 2029/3935* (2013.01); *B41J 2202/20* (2013.01)

(58) Field of Classification Search

None

See application file for complete search history.

(56) References Cited

U.S. PATENT DOCUMENTS

| | | | | |
|---|---|---|---|---|
| 8,100,499 | B2 * | 1/2012 | Mizes | B41J 2/2135 347/19 |
| 2011/0242186 | A1 * | 10/2011 | Mizes | B41J 2/2142 347/19 |
| 2012/0154477 | A1 | 6/2012 | Yamazaki | |
| 2013/0070011 | A1 * | 3/2013 | Nishida | B41J 2/2146 347/12 |
| 2016/0101638 | A1 * | 4/2016 | Ukishima | B41J 29/393 347/19 |
| 2017/0120647 | A1 * | 5/2017 | Kyoso | B41J 29/393 |

FOREIGN PATENT DOCUMENTS

| | | |
|---|---|---|
| JP | 2008012701 | 1/2008 |
| JP | 2012133582 | 7/2012 |
| JP | 2014226911 | 12/2014 |

* cited by examiner

*Primary Examiner* — Shelby Fidler

(74) *Attorney, Agent, or Firm* — Jianq Chyun IP Office

(57) ABSTRACT

The inkjet head ejection performance evaluation method includes: printing a test pattern for examining an ejection condition for each nozzle by an inkjet head having a plurality of nozzles arrayed in a matrix and is read by an image reading device; and measuring a depositing position for each nozzle from the read image to calculate a deposit displacement amount based on the depositing position and pattern information, wherein a position of a center of gravity in a Y direction of nozzles used for calculation for calculating the deposit displacement amount of the nozzle number n is equal to a position of a center of gravity in the Y direction of all nozzles existing in the nozzle range of the nozzles used for calculation, where a direction of relative movement between the inkjet head and a recording medium is the Y direction.

14 Claims, 22 Drawing Sheets

INKJET PRINT DEVICE AND INKJET HEAD EJECTION PERFORMANCE EVALUATION METHOD

CROSS-REFERENCE TO RELATED APPLICATIONS

The present application claims priority under 35 U.S.C. §119 to Japanese Patent Application No. 2015-226405, filed on Nov. 19, 2015. The above application is hereby expressly incorporated by reference, in its entirety, into the present application.

BACKGROUND OF THE INVENTION

Field of the Invention

The present invention relates to an inkjet print device and an inkjet head ejection performance evaluation method, and particularly relates to an inkjet print device using an inkjet head which has a plurality of nozzles arrayed in a matrix and a technology for evaluating ejection performance of the inkjet head.

Description of the Related Art

Japanese Patent Application Laid-Open No. 2008-012701 has described an inkjet print device which includes an elongated liquid droplets ejection head having a plurality liquid droplets ejection units arrayed in a width direction of a paper sheet, each liquid droplets ejection unit having a plurality of nozzles arrayed in a matrix and aligned in a row in a conveying direction of a paper sheet. Japanese Patent Application Laid-Open No. 2008-012701 has proposed a method for adjusting an attaching angle of a liquid droplets ejection head by detecting a displacement amount of the attaching angle in a rotation direction along a recording surface of a paper sheet for each liquid droplets ejection unit.

According to Japanese Patent Application Laid-Open No. 2008-012701, a line pattern is printed by the liquid droplets ejection head, a printed result thereof is read by an optical sensor to obtain read image data, from which a gap between adjacent lines is calculated, and the displacement amount of the attaching angle for each liquid droplets ejection unit is calculated based on the calculated line gap (claim 7, paragraph 0044 in Japanese Patent Application Laid-Open No. 2008-012701). The "paper sheet" in Japanese Patent Application Laid-Open No. 2008-012701 is a term corresponding to a "recording medium" herein, and the "liquid droplets ejection unit" in Japanese Patent Application Laid-Open No. 2008-012701 is a term corresponding to "inkjet head" herein.

Japanese Patent Application Laid-Open No. 2014-226911 has described a configuration in which a linear pattern formed by an inkjet head on a paper sheet is read by a scanner to obtain information, from which positional information on each linear pattern is obtained to calculate an inclination angle of the head (claim 1, paragraphs 0046-0047 and 0049-0055 in Japanese Patent Application Laid-Open No. 2014-226911). The "linear pattern in "Japanese Patent Application Laid-Open No. 2014-226911 is a term corresponding to the "line pattern" in Japanese Patent Application Laid-Open No. 2008-012701.

Japanese Patent Application Laid-Open No. 2012-133582 has described a technology in which a linear test pattern is formed by nozzles and a read image of the test pattern is analyzed to detect a defective ejection nozzle.

SUMMARY OF THE INVENTION

The inkjet head having a plurality of nozzles varies in ejection characteristics of the individual nozzles, and its ejection condition changes depending on an ink thickened within the nozzle or a foreign matter adhered. For example, if the foreign matter is adhered to or around the nozzle, liquid droplets ejected from the nozzle are affected to involve variations in an ejection direction, which makes it difficult to deposit the liquid droplets at a predetermined position on a recording medium. As a result, an output image quality by way of printing is lowered.

For this reason, it is preferable that the inkjet print device evaluates ejection performance of the inkjet head before performing a printing job or during performing the printing job to carry out a correction process or maintenance depending on an evaluation result in order to keep a good print quality.

There has been known, as one of methods for evaluating the ejection performance of the inkjet head, a technology in which a line pattern called a nozzle state check pattern is printed, the printed nozzle state check pattern is read by an image reading apparatus such a scanner and the like, and a deposit displacement for each nozzle is detected from the resultant read image (see Japanese Patent Application Laid-Open No. 2012-133582). The "deposit displacement" is equivalent to "displacement of a dot forming position," meaning displacement of a position where a dot actually is formed from an ideal position where the dot is to be formed. The "ideal position where the dot is to be formed" is a design targeted position and refers to a dot forming position in a state where no error is assumed. Various factors cause the displacement of a dot forming position, for example, a curve of the ejection direction of each nozzle causes the displacement. The dot forming position is equivalent to a depositing position. Additionally, measuring the depositing position of each nozzle corresponds to measuring the ejection direction of each nozzle.

However, this method has a problem that in a case where in a configuration using the inkjet head having a plurality of nozzles arrayed in a matrix thereon, the inkjet head is attached with having an angle deviation in the rotation direction along the recording surface of the recording medium, the deposit displacement of each nozzle cannot be accurately evaluated.

The technologies described in Japanese Patent Application Laid-Open No. 2008-012701 and Japanese Patent Application Laid-Open No. 2014-226911, although the displacement amount of the attaching angle for the inkjet head is calculated from the printed result of the line pattern, the calculated displacement amount is used to adjust the attaching angle for the inkjet head (attitude adjustment). The technologies described in Japanese Patent Application Laid-Open No. 2008-012701 and Japanese Patent Application Laid-Open No. 2014-226911 cannot deal with the above problem.

Particularly, the inkjet print device is required to give a stable output of printing under a continuous operation from the view point of improving productivity of a printed matter. For this reason, a case where an ejection defective nozzle is detected when the ejection performance of the inkjet head of the inkjet print device in operation is evaluated needs to be dealt with by the correction process, head cleaning or the like. Regarding this point, the technologies described in Japanese Patent Application Laid-Open No. 2008-012701 and Japanese Patent Application Laid-Open No. 2014-226911 are difficult to apply to evaluating the ejection performance of the inkjet head of the inkjet print device in operation.

The present invention has been made in consideration such a circumstance, and has an object to provide an inkjet print device and inkjet head ejection performance evaluation method capable of accurately evaluating an ejection condition of each nozzle even in a case where an inkjet head is attached with having an angle deviation in a rotation direction along a recording surface of a recording medium.

A solution to solve the problems is as described below.

An inkjet print device according to a first aspect includes: an inkjet head having a plurality of nozzles arrayed in a matrix; a test pattern output control device configured to control the inkjet head to record a test pattern for examining an ejection condition for each of the nozzles on a recording medium; an image reading device configured to optically read an image of the test pattern recorded on the recording medium; a first calculation device configured to measure a depositing position for each of the nozzles from the image of the test pattern read by the image reading device; and a second calculation device configured to calculate a deposit displacement amount for each of the nozzles based on the depositing position measured by the first calculation device and pattern information of the test pattern, wherein the test pattern is a line pattern for recording a line for each of the nozzles in a Y direction, and is divided into two or more line groups in the Y direction to be recorded on the recording medium, where the Y direction is a direction of relative movement between the inkjet head and the recording medium, and a position of a center of gravity in the Y direction of $N_A$ nozzles used for calculation is equal to a position of a center of gravity in the Y direction of $N_B$ nozzles existing in a nozzle range of the nozzles used for calculation, where n is a nozzle number of a nozzle of which deposit displacement amount is calculated by the second calculation device, and $N_A$ is a number of the nozzles used for calculation that record lines used for calculation for calculating the deposit displacement amount of the nozzle of the nozzle number n, and $N_B$ is a number of all nozzles existing in the nozzle range of the $N_A$ nozzles used for calculation in a nozzle array in a matrix.

Each of the nozzles in the nozzle array having therein a plurality of nozzles arrayed in a matrix can be given the nozzle number identifying the nozzle, and the nozzle number allows the nozzle in the inkjet head to be uniquely identified. In a case of carrying out calculation for finding the deposit displacement amount of the nozzle of a certain nozzle number n from the read image of the test pattern, the calculation can be carried out by use of measured data of the plural lines in the line group to which the line recorded by the nozzle number n belongs.

The nozzles recording the plural lines which are used for the calculation for finding the deposit displacement amount of the nozzle of the nozzle number n is the "nozzles used for calculation", and the number of the plural lines used for the calculation for finding the deposit displacement amount of the nozzle of the nozzle number n, that is, the number of the nozzles used for calculation is $N_A$. The numeral $N_A$ may be defined as an adequate integer equal to or more than 2. The numeral $N_A$ is preferably an integer of 20 or more and 50 or less, for example, in terms of accuracy of the calculation for finding the deposit displacement amount and a time taken for the process.

In the nozzle array in a matrix, there are nozzles not used for the calculation for finding the deposit displacement amount of the nozzle number n around the nozzles used for calculation. There are, in the nozzle range in which $N_A$ nozzles used for calculation are distributed, $N_B$ nozzles in total of the nozzles used for calculation and calculational non-use nozzles not used for calculation. The numeral $N_B$ is an integer larger than $N_A$, and depends on the nozzle array of the inkjet head.

In the first aspect, used is the test pattern meeting the condition that, in the nozzle array of the inkjet head, the position of the center of gravity in the Y direction of $N_A$ nozzles used for calculation is equal to the position of the center of gravity in the Y direction of $N_B$ nozzles existing in the nozzle range of the nozzles used for calculation. If such a condition is met, $N_A$ nozzles used for calculation used for calculation for calculating the deposit displacement amount of the nozzle of the nozzle number n are distributed generally evenly in a nozzle area in the Y direction in the nozzle array in a matrix.

According to the first aspect, if the inkjet head is attached with having the angle deviation in the rotation direction along the recording surface of the recording medium, a behavior due to rotation (angle deviation) of $N_A$ nozzles used for calculation coincides with a behavior of all nozzles existing in the nozzle range of the nozzles used for calculation (all nozzles including near nozzles which are not used for calculation for finding the deposit displacement amount of the nozzle of the nozzle number n). In other words, an average value of moving amounts due to the rotation of $N_A$ nozzles used for calculation is equal to an average value of moving amounts due to the rotation of all nozzles existing in the nozzle range of the nozzles used for calculation. Therefore, from information on the depositing positions of $N_A$ nozzles belonging to a part of the line groups in the test pattern, the deposit displacement amount can be calculated which accurately takes an influence due to the angle deviation.

The term "equal to" or "coincide with" herein is not limited to a case of being strictly equal to or coinciding with, but includes a case dealt with as being "equal to" or "coinciding with" including a range of a permissible error.

The nozzles used for calculation used for calculation for finding the deposit displacement amount may or may not include the nozzle of the nozzle number n. Moreover, the all nozzles in the nozzle range of the nozzles used for calculation may or may not include the nozzle of the nozzle number n.

The "nozzle range of the nozzles used for calculation" is the nozzle range in which $N_A$ nozzles used for calculation for finding the deposit displacement amount are distributed in the nozzle array of the inkjet head, and corresponds to a range of the nozzle numbers of $N_A$ nozzles used for calculation. The nozzle range of the nozzles used for calculation may be the nozzle range from the minimum nozzle number to the maximum nozzle number of $N_A$ nozzles used for calculation.

The "position of the center of gravity in the Y direction" means a position of the center of gravity in the Y direction defined from the positional coordinates of the nozzle and corresponds to the Y coordinate of the center of gravity. The position of the center of gravity in the Y direction of $N_A$ nozzles may be defined as an average value of the Y coordinates of $N_A$ nozzles.

The lines constituting the line group in the test pattern divided in the Y direction may be configured to be aligned in a width direction of the recording medium perpendicular to the Y direction at a regular pitch, or at an irregular pitch.

A second aspect may be such that, in the inkjet print device according to the first aspect, $\Sigma_A y_i/N_A$ is equal to $\Sigma_B y_i/N_B$, where i is an integer representing a nozzle number identifying each nozzle in the nozzle array, $y_i$ is a Y coordinate representing a position of the nozzle of the nozzle number i in the Y direction, $\Sigma_A y_i$ is a sum of Y coordinates of the $N_A$ nozzles used for calculation, and $\Sigma_B y_i$ is a sum of Y coordinates of the $N_B$ nozzles existing in the nozzle range of the nozzles used for calculation.

The expression $\Sigma_A y_i/N_A$ represents the position of the center of gravity in the Y direction of $N_A$ nozzles used for calculation which are used for calculation for finding the nozzle of the nozzle number n of the deposit displacement amount. $\Sigma_B y_i/N_B$ represents the position of the center of gravity in the Y direction of $N_B$ nozzles which exist in the nozzle range of the nozzles used for calculation.

A third aspect may be such that, in the inkjet print device according to the first aspect or the second aspect, in a case where a difference between the position of the center of gravity in the Y direction of the $N_A$ nozzles used for calculation and the position of the center of gravity in the Y direction of the $N_B$ nozzles existing in the nozzle range of the nozzles used for calculation is within 20% of a distance in the Y direction of an area in which the nozzles exist in the nozzle array in a matrix, this case meets a condition that the position of the center of gravity in the Y direction of the $N_A$ nozzles used for calculation is equal to the position of the center of gravity in the Y direction of the $N_B$ nozzles existing in the nozzle range of the nozzles used for calculation.

In the case where the difference between the position of the center of gravity in the Y direction of $N_A$ nozzles used for calculation which are used for calculation for finding the deposit displacement amount of the nozzle of the nozzle number n and the position of the center of gravity in the Y direction of $N_B$ nozzles which exist in the nozzle range of the nozzles used for calculation is within 20% of D, this case can be dealt with as that the positions of the center of gravity in the Y direction are "equal", where D is the distance in the Y direction of the area in which the nozzles exist in the nozzle array in a matrix, that is, a distance from a nozzle on one end in the Y direction to a nozzle on the other end in the nozzle array.

A fourth aspect may be such that, the inkjet print device according to any one of the first aspect to the third aspect includes a relative moving device configured to cause relative movement between the inkjet head and the recording medium, in which the inkjet head has a nozzle array in which the plural nozzles are arrayed in two or more alignments in the Y direction.

A two-dimensional nozzle array in two or more alignments in the Y direction corresponds to the nozzle array "in a matrix".

A fifth aspect may be such that, in the inkjet print device according to any one of the first aspect to the fourth aspect, of the line groups in the test pattern, at least lines used for calculation for calculating the deposit displacement amount of the nozzle of the nozzle number n are aligned at a regular pitch of the number of divisions k, $N_r$ and k are respectively an integer equal to or more than 2, and $N_r$ is coprime to k, where $N_r$ is the number of alignments of the nozzles in the Y direction in the nozzle array.

A certain numeral a being "coprime to" a certain numeral b means that they have no common factor other than "1" or "−1".

As an example of the test pattern in the fifth aspect, a configuration may be used in which a pattern of N=k−1 in a so-called "1-on-N-off" type line pattern is used and $N_r$ is coprime to k.

According to the fifth aspect, the test pattern is easy to design and an analyzing process of the read image is also easy as compared with a case of using the line pattern with the irregular pitch.

A sixth aspect may be configured such that the inkjet print device according to any one of the first aspect to the fifth aspect includes a test pattern generating device configured to generate data of the test pattern, in which the test pattern output control device controls ejection from the inkjet head based on the data of the test pattern.

A seventh aspect may be configured such that, in the inkjet print device according to any one of the first aspect to the sixth aspect, the first calculation device measures a position of the line as the depositing position for each of the divided line groups.

An eighth aspect may be configured such that the inkjet print device according to the seventh aspect includes an approximate curve calculation device configured to calculate an approximate curve from data of the depositing position measured for each of the divided line groups, in which the second calculation device calculates the deposit displacement amount from the approximate curve and the data of the depositing position.

A ninth aspect may be configured such that, in the inkjet print device according to the eighth aspect, the nozzles used for calculation are the nozzles used for calculation for calculating the approximate curve, and the approximate curve is obtained based on measured data of $N_A$ lines recorded by the $N_A$ nozzles used for calculation.

A tenth aspect may be configured such that, in the inkjet print device according to any one of the first aspect to the ninth aspect, a third calculation device configured to calculate a distance between adjacent pixels by using a calculation result by the second calculation device.

An eleventh aspect may be configured such that the inkjet print device according to the tenth aspect further includes an ejection disabling processing device configured to disable a defective nozzle from ejection, the distance between the adjacent pixels calculated for the defective nozzle by the third calculation device being out of a prescribed acceptable range, and a correction processing device configured to perform image correction to supplement an image defection which is involved by disabling the defective nozzle from ejection by use of near nozzles around the defective nozzle.

A twelfth aspect may be configured such that the inkjet print device according to any one of the first aspect to the ninth aspect further includes an ejection disabling processing device configured to disable a defective nozzle from ejection, the deposit displacement amount of the defective nozzle calculated by the second calculation device exceeding a threshold, and a correction processing device configured to perform image correction to supplement an image defection which is involved by disabling the defective nozzle from ejection by use of near nozzles around the defective nozzle.

A thirteenth aspect may be configured such that the inkjet print device according to any one of the first aspect to the twelfth aspect includes a determining device configured to determine presence or absence of abnormality based on the calculation result by the second calculation device, in which at least an operation of correction process or head maintenance is performed in a case where ejection abnormality is determined by the determining device.

An inkjet head ejection performance evaluation method according to a fourteenth aspect includes a test pattern outputting step of, in an inkjet head having a plurality of nozzles arrayed in a matrix, recording a test pattern on a recording medium by the inkjet head, the test pattern being for examining an ejection condition for each of the nozzles, an image reading step of optically reading an image of the test pattern recorded on the recording medium, a first calculation step of measuring a depositing position for each of the nozzles from the read image of the test pattern read in the image reading step, and a second calculation step of calculating a deposit displacement amount for each of the nozzles based on the depositing position measured in the first calculation step and pattern information of the test pattern, in which the test pattern is a line pattern for recording a line for each of the nozzles in the Y direction, and is divided into two or more line groups in the Y direction to be recorded on the recording medium, where a Y direction is a direction of relative movement between the inkjet head and the recording medium, and a position of the center of gravity in the Y direction of $N_A$ nozzles used for calculation is equal to a position of the center of gravity in the Y direction of $N_B$ nozzles existing in the nozzle range of the nozzles used for calculation, where n is a nozzle number of a nozzle of which deposit displacement amount is found by the second calculation step, and $N_A$ is the number of nozzles used for calculation which record the lines used for calculation for finding the deposit displacement amount of the nozzle of the nozzle number n, and $N_B$ is the number of all nozzles existing in a nozzle range of $N_A$ nozzles used for calculation in the nozzle array in a matrix.

In the fourteenth aspect, matters the same as the matters specified from the first aspect to the thirteenth aspect may be adequately combined. In this case, a device which performs the processes and functions specified in the inkjet print device may be grasped as an element of "steps" of corresponding processes and functions.

According to the present invention, the ejection condition of each nozzle can be accurately evaluated even in a case where the inkjet head is attached with having the angle deviation in the rotation direction along the recording surface of the recording medium.

DETAILED DESCRIPTION OF THE EMBODIMENTS

Hereinafter, a description is given of the preferred embodiments of the present invention in detail with reference to the attached drawings.

<<Configuration Example of Inkjet Print Device>>

Figure 1:
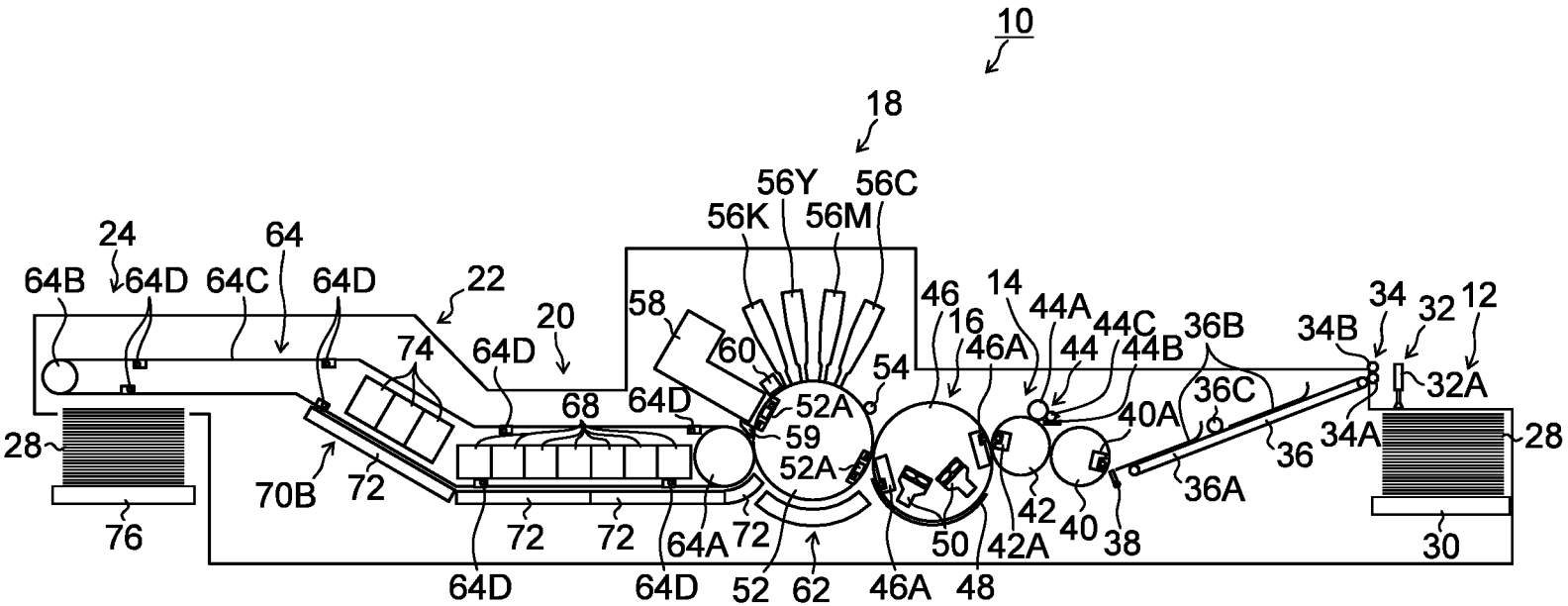
FIG. 1 is a configuration view of an inkjet print device according to an embodiment.

FIG. 1 is a configuration view of an inkjet print device according to an embodiment. An inkjet print device 10 is configured to include a paper feed unit 12, a treatment liquid applying section 14, a treatment liquid drying treatment unit 16, an image formation unit 18, an ink drying treatment unit 20, a UV irradiation treatment unit 22, and a paper output unit 24.

The paper feed unit 12 is a mechanism for feeding a recording medium 28 to the treatment liquid applying section 14. The paper feed unit 12 is configured to include a paper feed platform 30, a paper feed device 32, a paper feed roller pair 34, a feeder board 36, a front stop 38, and a paper feed drum 40, and feeds a recording medium 28 as a paper sheet stacked on the paper feed platform 30 one by one to the treatment liquid applying section 14. Note that in the example, a cut paper sheet (cut sheet) is used as the recording medium 28, but there may be also used a configuration in which a sheet of a required size is cut out from continuous paper (roll paper) to feed.

The recording media 28 stacked on the paper feed platform 30 are lifted from the top thereof one by one by a suction fit 32A of the paper feed device 32 and fed to the paper feed roller pair 34. The recording medium 28 fed to the paper feed roller pair 34 is fed forward by a vertical pair of rollers 34A and 34B to be placed on the feeder board 36.

The recording medium 28 placed on the feeder board 36 is conveyed by a tape feeder 36A provided on a conveying surface of feeder board 36.

The recording medium 28 is pressed against the conveying surface of the feeder board 36 by a retainer 36B and a guide roller 36C in a conveying course by way of the feeder board 36 to correct irregularity. The recording medium 28 conveyed by the feeder board 36 abuts on the front stop 38 at the leading end thereof to be corrected in inclination. After that, the recording medium 28 is conveyed to the treatment liquid applying section 14 with a leading end portion thereof being gripped by a gripper 40A of the paper feed drum 40.

The treatment liquid applying section 14 is a mechanism for applying a treatment liquid on the recording surface of the recording medium 28. The treatment liquid applying section 14 is configured to include a treatment liquid applying drum 42 and a treatment liquid applying unit 44.

The treatment liquid contains a constituent which aggregates or thickens coloring materials (pigment or dye) in the ink. Examples of a method for aggregating or thickening the coloring materials include those using a treatment liquid which reacts with the ink to precipitate or insolubilize the coloring material in the ink and a treatment liquid generating a semisolid substance (gel) including the coloring material in the ink, for example. Examples of a measure for causing the reaction between the ink and the treatment liquid include a method for reacting an anionic coloring material in the ink with a cationic compound in the treatment liquid, a method in which the ink and the treatment liquid different from each other in pH (potential of hydrogen) are mixed to change the pH of the ink so as to cause dispersion destruction of the pigment in the ink to aggregate the pigment, and a method in which reaction with a multivalent metal salt in the treatment liquid causes dispersion destruction of the pigment in the ink to aggregate the pigment.

The recording medium 28 fed from the paper feed unit 12 is transferred from the paper feed drum 40 to the treatment liquid applying drum 42. The treatment liquid applying drum 42 rotates with gripping a leading end of the recording medium 28 by a gripper 42A so as to convey the recording medium 28 in a state of being wrapped on a drum circumferential surface thereof.

In a conveying course for the recording medium 28 by way of the treatment liquid applying drum 42, a coating roller 44A given a constant amount of the treatment liquid measured by a measuring roller 44C from a treatment liquid pan 44B is pressed and brought to and into contact with a surface of the recording medium 28 to coat the treatment liquid on the surface of the recording medium. Note that an aspect for coating the treatment liquid is not limited to coating by a roller, and other aspects may be applied used such as inkjet printing and coating by means of a blade.

The treatment liquid drying treatment unit 16 is configured to include a treatment liquid drying drum 46, a conveyance guide 48, and a treatment liquid drying treatment unit 50, and subjects the recording medium 28 given the treatment liquid to drying treatment.

The recording medium 28 transferred from the treatment liquid applying drum 42 to the treatment liquid drying drum 46 is gripped at the leading end thereof by a gripper 46A which is provided to the treatment liquid drying drum 46. The recording medium 28 is gripped by the gripper 46A in a state where a surface thereof on a side on which the treatment liquid is coated faces toward an inside of the treatment liquid drying drum 46. Additionally, a rear surface of the recording medium 28 (which is opposite to the side on which the treatment liquid is coated) is supported by the conveyance guide 48. In this state, the treatment liquid drying drum 46 is rotated to convey the recording medium 28.

The treatment liquid drying treatment unit 50 is provided to the inside of the treatment liquid drying drum 46. In a course of conveying the recording medium 28 by the treatment liquid drying drum 46, the surface of the recording medium 28 receives a hot air blown by the treatment liquid drying treatment unit 50 such that the recording medium 28 is subjected to the drying treatment. This removes a solvent component in the treatment liquid to form an ink aggregation layer on the surface of the recording medium 28.

The image formation unit 18 is configured to include an image forming drum 52, a paper sheet pressing roller 54, head units 56C, 56M, 56Y, and 56K, an inline sensor 58, a mist filter 60, and a drum cooling unit 62.

The image forming drum 52 which is provided with a gripper 52A can hold the leading end of the recording medium 28 by the gripper 52A. The recording medium 28 is conveyed in a state where the leading end thereof is held by the gripper 52A by way of rotation of the image forming drum 52. The image forming drum 52 has a plurality of suction apertures (not shown) on a circumferential surface thereof so as to hold the recording medium 28 by suction on the circumferential surface of the image forming drum 52 with a negative pressure generated through the suction apertures.

The paper sheet pressing roller 54 presses the recording medium 28 conveyed by the image forming drum 52 to make the recording medium 28 tightly contact with a circumferential surface of the image forming drum 52. In other words, the recording medium 28 transferred from the treatment liquid drying drum 46 to the image forming drum 52 is gripped at the leading end thereof by the gripper 52A of the image forming drum 52. Further, the recording medium 28 is made to pass under the paper sheet pressing roller 54 such that the recording medium 28 is brought into tight contact with the circumferential surface of the image forming drum 52.

The recording medium 28 brought into tight contact with the circumferential surface of the image forming drum 52 is suctioned with the negative pressure generated through the suction apertures formed on the circumferential surface of the image forming drum 52 so as to be held by suction on the circumferential surface of the image forming drum 52.

The recording medium 28 fixed on the image forming drum 52 is conveyed in a state where the recording surface faces an outer side, and given the ink applied on the recording surface of the recording medium 28 from the head units 56C, 56M, 56Y, and 56K in passing through an ink droplets deposition area immediately beneath the head units 56C, 56M, 56Y, and 56K. The mist filter 60 is a filter for catching ink mist.

The head unit 56C is a liquid droplets ejection unit for ejecting liquid droplets of ink of cyan (C). The head unit 56M is a liquid droplets ejection unit for ejecting liquid droplets of ink of magenta (M). The head unit 56Y is a liquid droplets ejection unit for ejecting liquid droplets of ink of yellow (Y). The head unit 56K is a liquid droplets ejection unit for ejecting liquid droplets of ink of black (K). The head units 56C, 56M, 56Y, and 56K are respectively supplied with the inks of corresponding colors from ink tanks not shown.

The head unit 56C, 56M, 56Y, and 56K each are a full-line type inkjet recording head having a length corresponding to a maximum width of an image forming area in the recording medium 28, and an ink ejecting surface of the head has a plurality of ink ejecting nozzles two-dimensionally arrayed in a matrix thereon over the entire width of the image forming area. The full-line type recording head is also referred to as a "page-wide head". Each of the head units 56C, 56M, 56Y, and 56K corresponds to an aspect of the "inkjet head".

The head units 56C, 56M, 56Y, and 56K are disposed so as to extend in a direction perpendicular to a conveying direction (rotation direction of a drawing drum 70) of the recording medium 28. The conveying direction recording medium 28 is referred to as a "sub-scanning direction", and the width direction of the recording medium 28 which is perpendicular to the sub-scanning direction is referred to as a "main scanning direction". A description is given herein assuming that the sub-scanning direction is a Y direction and the main scanning direction is an X direction.

In a case of the inkjet head having a two-dimensional nozzle array, it may be considered that a projected nozzle alignment in which the nozzles in the two-dimensional nozzle array are projected (orthogonal projection) so as to be aligned along the main scanning direction is equivalent to one row of a nozzle alignment in which the nozzles are aligned approximately at regular intervals in the main scanning direction at a nozzle density attaining a maximum print resolution. The term "approximately at regular intervals" means that droplet deposition points recordable by the inkjet print device are substantially at regular intervals. For example, the concept of "regular intervals" includes a case where the interval is slightly differentiated in consideration of a manufacturing error or movement of liquid droplets on the recording medium 28 due to deposit interference. When the projected nozzle alignment (also referred to as a "substantial nozzle alignment") is considered, each of orders in which the projection nozzles are aligned in the main scanning direction can be associated with the nozzle number representing the nozzle position.

An operation only one time to move the recording medium 28 relative to the full-line type head units 56C, 56M, 56Y, and 56K like this, that is, one time sub-scanning, allows an image of a prescribed print resolution to be recorded on the image forming area of the recording medium 28. A drawing method capable of completing an image with one drawing scanning is called single-pass printing. The image forming drum 52 corresponds to an aspect of a "relative moving device".

A droplet ejection timing for each of the head units 56C, 56M, 56Y, and 56K is synchronized with a signal of an encoder (encoder signal) not shown which detects a rotation speed of the image forming drum 52. An ejection triggering signal is generated based on the encoder signal to control the droplet ejection timings for the head units 56C, 56M, 56Y, and 56K based on the ejection triggering signal. Additionally, speed variation due to a wobble of the image forming drum 52 or the like is learned in advance to correct the droplet ejection timing obtained by the encoder such that droplet deposition non-uniformity can be reduced independently of the wobble of the image forming drum 52, accuracy of a rotary shaft, and a speed of the outer circumferential surface of the image forming drum 52.

Although a configuration with the CMYK standard colors (four colors) is described in the example, combinations of the ink colors or the number of colors are not limited to those, and light inks, dark inks or special color inks may be added as required. For example, there may be also used a configuration in which the head unit ejecting a light series ink such as light cyan and light magenta is added, and an order to arrange the heads of the respective colors is not specifically limited.

Further, a head maintenance operation such as cleaning of nozzle surfaces of the head units 56C, 56M, 56Y, and 56K, and thickened ink discharge is performed after retracting the head units 56C, 56M, 56Y, and 56K from the image forming drum.

The inline sensor 58 is an optical reading device which optically reads the image recorded on the recording medium 28 to generate data of the read image. The inline sensor 58 corresponds to an aspect of an "image reading device". The read image is also called a "scanned image". The inline sensor 58 is configured to include a color CCD linear image sensor which performs color separation into three colors of R (red), G (green), and B (blue), for example. The term CCD is an abbreviation for Charge-Coupled Device. Note that a color CMOS linear image sensor may be used in place of the color CCD linear image sensor. The term CMOS is an abbreviation for Complementary Metal Oxide Semiconductor.

When the recording medium 28 in which the image is formed by the head units 56C, 56M, 56Y, and 56K passes through a reading area of the inline sensor 58, the image formed on the surface is read. Examples of the image printed on the recording medium 28, besides an image to be printed which is specified by the printing job, can include a nozzle state check pattern for examining the ejection condition for each nozzle, a printing density correction test pattern, a printing density unevenness correction test pattern, and other various test patterns.

The image reading by the inline sensor 58 is carried out as required to detect ejection defection or image defection (image abnormality) such as the printing density unevenness from the read image data. The recording medium 28 after passing through the reading area of the inline sensor 58 passes through beneath a guide 59 after the suction is released and is transferred to the ink drying treatment unit 20.

The ink drying treatment unit 20 is configured to include an ink drying treatment unit 68 which subjects the recording medium 28 conveyed by a chain gripper 64 to drying treatment. The ink drying treatment unit 20 subjects the recording medium 28 after the image formation to the drying treatment to remove a liquid component remaining on the surface of the recording medium 28.

Configuration examples of the ink drying treatment unit 68 include an aspect which includes a heat source such as a halogen heater and an infrared heater, and a fan blowing an air heated by the heat source to the recording medium 28.

The recording medium 28 transferred from the image forming drum 52 in the image formation unit 18 to the chain gripper 64 is gripped at the leading end thereof by a gripper 64D which is provided to the chain gripper 64. The chain gripper 64 has a structure in which a pair of endless chains 64C is wound around a first sprocket 64A and a second sprocket 64B.

The rear surface of a rear end of the recording medium 28 is held by suction on by a paper sheet holding surface of a guide plate 72 which is arranged at a certain distance from the chain gripper 64.

The UV irradiation treatment unit 22 is configured to include a UV irradiation unit 74, and uses an ultraviolet curable ink to irradiate the recorded image with ultraviolet rays to fix the image on the surface of the recording medium 28.

When the recording medium 28 conveyed by the chain gripper 64 reaches a UV ray irradiation region of the UV irradiation unit 74, it is subjected to UV irradiation treatment by the UV irradiation unit 74 provided inside the chain gripper 64.

In other words, the recording medium 28 conveyed by the chain gripper 64, in a conveying path for the recording medium 28, is irradiated with the ultraviolet rays from the UV irradiation unit 74 which is arranged at a position corresponding to the surface of the recording medium 28. A curing reaction occurs in the ink irradiated with the ultraviolet rays and the image is fixed on the surface of the recording medium 28.

The recording medium 28 subjected to the UV irradiation treatment is transferred via an inclined conveying path 70B to the paper output unit 24. A cooling treatment unit may be included which subjects the recording medium 28 passing through the inclined conveying path 70B to cooling treatment.

The paper output unit 24 is configured to include a paper output platform 76 which collects in a stacking manner the recording medium 28 having been subjected to a series of image formation process. The chain gripper 64 releases the recording medium 28 above the paper output platform 76 to stack the recording medium 28 on the paper output platform 76. The paper output platform 76 collects the recording medium 28 released from the chain gripper 64 in a stacking manner. The paper output platform 76 is provided with sheet guides (not shown) (a front sheet guide, a rear sheet guide, a side sheet guide, and the like) such that the recording media 28 are orderly stacked.

The paper output platform 76 is provided by means of a paper output platform lifting and lowering device so as to be lifted and lowered. The paper output platform lifting and lowering device is controlled to be driven in conjunction with increase or decrease of the recording medium 28 stacked on the paper output platform 76 to lift and lower the paper output platform 76 such that the recording medium 28 placed on the top of the stack is always positioned at a certain height.

[Structural Example of Head Unit]

Figure 2:
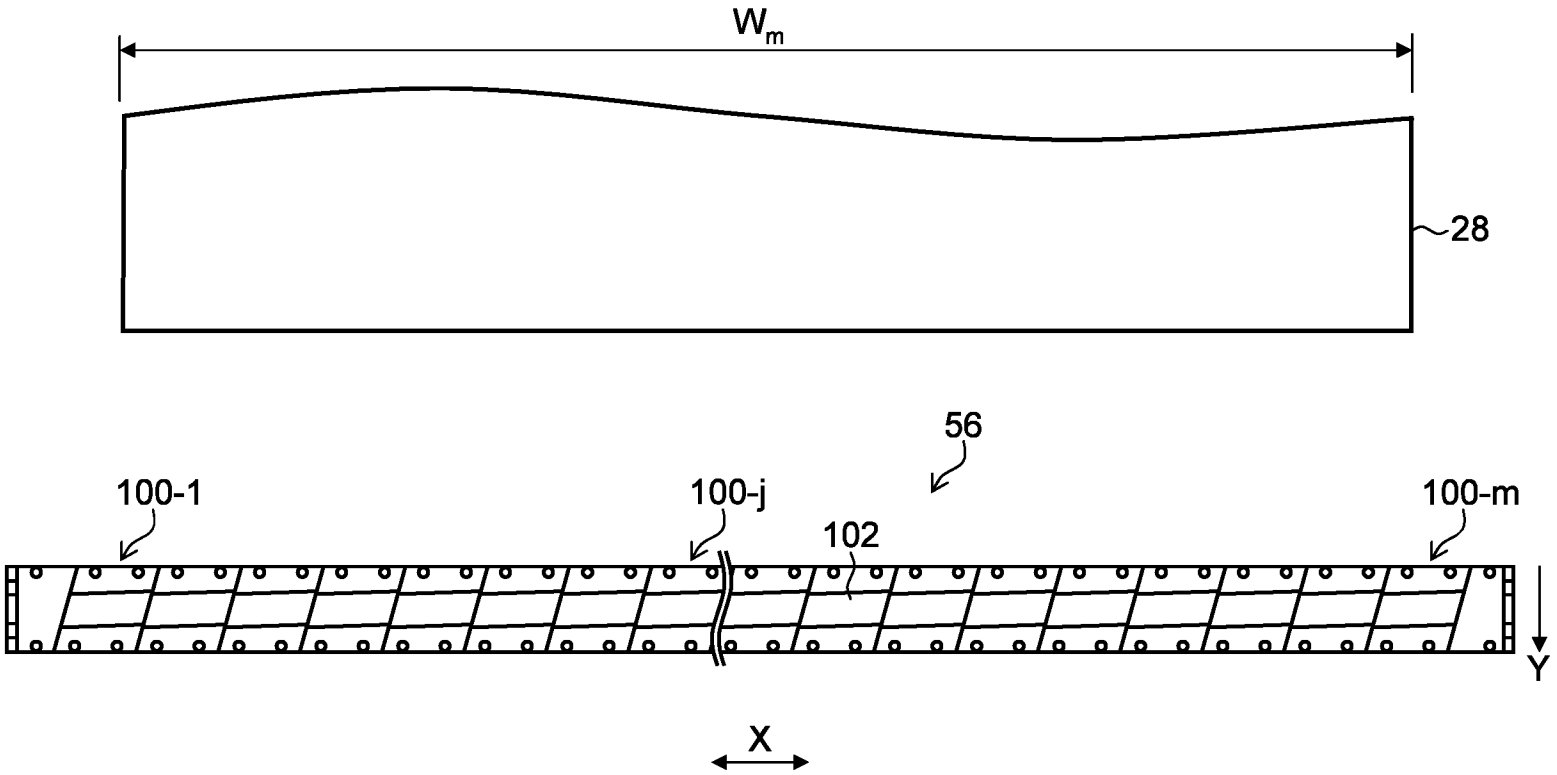
FIG. 2 is a configuration view of a head unit.

FIG. 2 is a configuration view of the head unit 56. Since the head units 56C, 56M, 56Y, and 56K illustrated in FIG. 1 have the same structure applied, these are expressed as the head unit 56 when they do not need to be distinguished.

The head unit 56 shown in FIG. 2 has a structure in which plural inkjet heads 100-*j* are coupled with each other in the width direction (X direction) of the recording medium 28 perpendicular to the conveying direction (Y direction) of the recording medium 28. A branch number "j" suffixed after "-" (hyphen) of reference numeral and character "100-*j*" is an integer from 1 to m and represents the j-th head module. The integer m here is the number of the inkjet heads constituting the head unit 56 as an inkjet head bar, and FIG. 2 shows an example of m=17. Since the inkjet heads 100-*j* (j=1, 2, . . . m) has also the same structure applied, these are expressed as an inkjet head 100 when they do not need to be distinguished.

Figure 3:
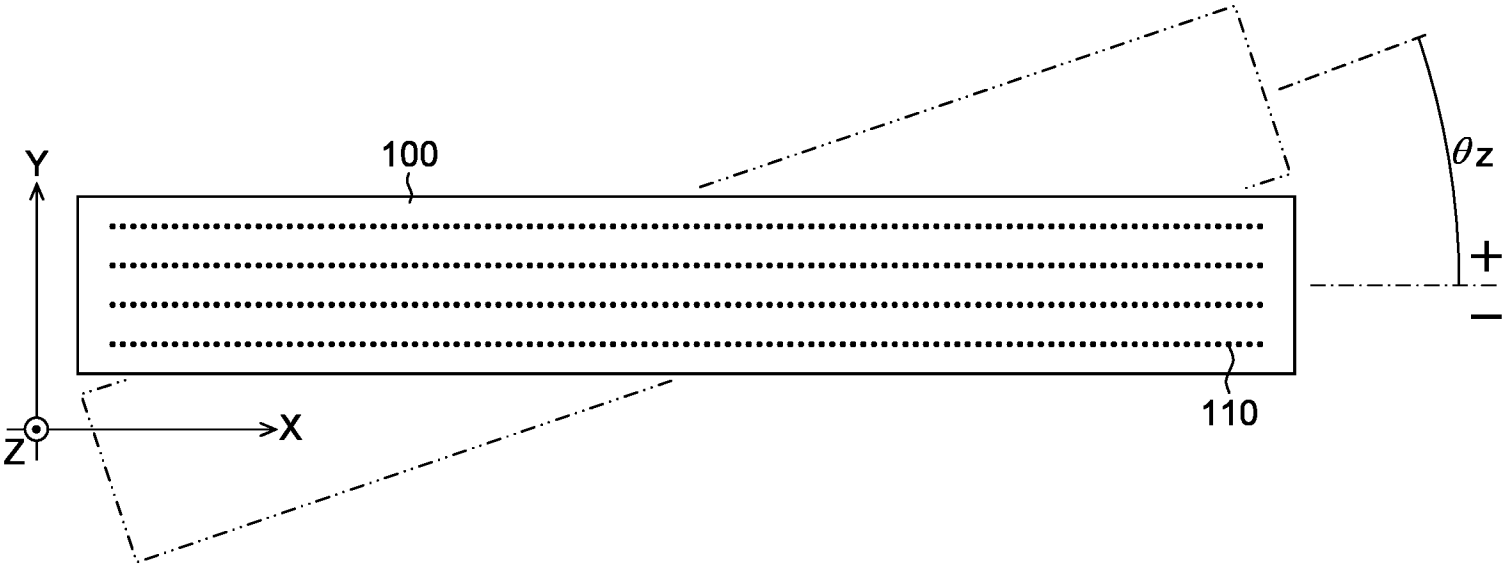
FIG. 3 is a schematic perspective plan view of an inkjet head seen down toward an ink ejected direction.

A nozzle surface 102 of the inkjet head 100 has a plurality of openings of the nozzles arranged thereon (not shown in FIG. 2, but shown in FIG. 3 and designated by reference numeral 110). The "nozzle surface" is equivalent to the "ink ejecting surface".

The head unit 56 is a multi-nozzle head in which plural nozzles are arranged in a matrix across a length corresponding to an entire width Wm of the recording medium 28. The "entire width of the recording medium 28" corresponds to an entire length of the recording medium 28 in the width direction of the recording medium 28. The multi-nozzle head in which plural nozzles are arrayed in a matrix is called a "matrix head".

FIG. 3 is a schematic perspective plan view of the inkjet head 100 seen down toward an ink ejected direction; FIG. 3 schematically shows the nozzle array in a matrix which is shown as an array simpler than an actual array form. As shown in FIG. 3, a description is given with introducing an XYZ triaxial rectangular coordinate system. The recording medium conveying direction is assumed to be the Y direction. The recording medium width direction orthogonal to the Y direction is assumed to be the X direction. A direction orthogonal to an XY plane is defined as the Z direction.

The Z direction is a direction orthogonal to the recording surface of the recording medium 28 which faces the inkjet head 100 (not shown in FIG. 3, see FIG. 1 and FIG. 2), and corresponds to a normal line of the recording medium 28. A rotation angle about a Z-axis of the inkjet head 100 is referred to as a "head rotation angle" and represented by "θz". That is, the head rotation angle θz represents the rotation angle along the XY plane in the rotation direction of the inkjet head 100.

A relative positional relationship between the recording medium 28 (not shown in FIG. 3, see FIG. 1 and FIG. 2) and the inkjet head 100 is that the recording medium 28 is positioned at a lower side in a direction of gravitational force than the inkjet head 100 which is arranged upward with respect to the recording surface of the recording medium 28. In the case of FIG. 3, the recording medium 28 is arranged at a position in a more minus direction of the Z-axis than the inkjet head 100 and the ink is ejected from nozzles 110 of the inkjet head 100 toward the minus direction of the Z-axis.

An example of the number of the nozzles 110 of the inkjet head 100 shown in FIG. 3 is 2048. The inkjet head 100 is the matrix head in which 2048 nozzles 110 are two-dimensionally arrayed in a matrix of 4 rows×512 columns. In the two-dimensional nozzle array of the matrix head, the X direction corresponds to a "row direction" and the Y direction corresponds to a "column direction".

Although simplified in FIG. 3, in the inkjet head 100, there are four nozzle rows at different locations in the Y direction, each nozzle row having the nozzles 110 aligned in the X direction at 300 npi, and the nozzle positions are shifted in the X direction between the respective nozzle rows from each other by 21.2 micrometers (μm). This attains the nozzle density of 1200 npi in the X direction all over the inkjet head 100. The term "npi" means nozzle per inch and is a unit representing the number of nozzles per one inch. One inch corresponds to 25.4 millimeters (mm). Since one nozzle can record a dot for one pixel, npi can be replaced with dpi to be understood. The term "dpi" means dot per inch and is a unit representing the number of dots (points) per one inch. The matrix head having the nozzle density in the X direction of 1200 npi is used for printing to attain a recording resolution of 1200 dpi in the X direction. The recording resolution is equivalent to the print resolution.

If the inkjet head 100 has the nozzle array in a matrix as shown in FIG. 3, a projected nozzle pitch of nozzles which are projected to an X-axis with respect to a rotation on the XY plane is changed from a proper nozzle pitch. The "proper nozzle pitch" means a design ideal nozzle pitch. The nozzle pitch is equivalent to the nozzle interval. In the example, a design nozzle density is 1200 npi, and thus, the proper nozzle pitch is 21.2 micrometers (μm).

Here, a proper head rotation angle θz with which the nozzles 110 projected to the X-axis are aligned at 1200 npi is defined as θz=0. A sign for θz is defined such that a counterclockwise rotation is positive as in FIG. 3. θz=0 corresponds to a reference attaching angle of the inkjet head 100.

Figure 4:
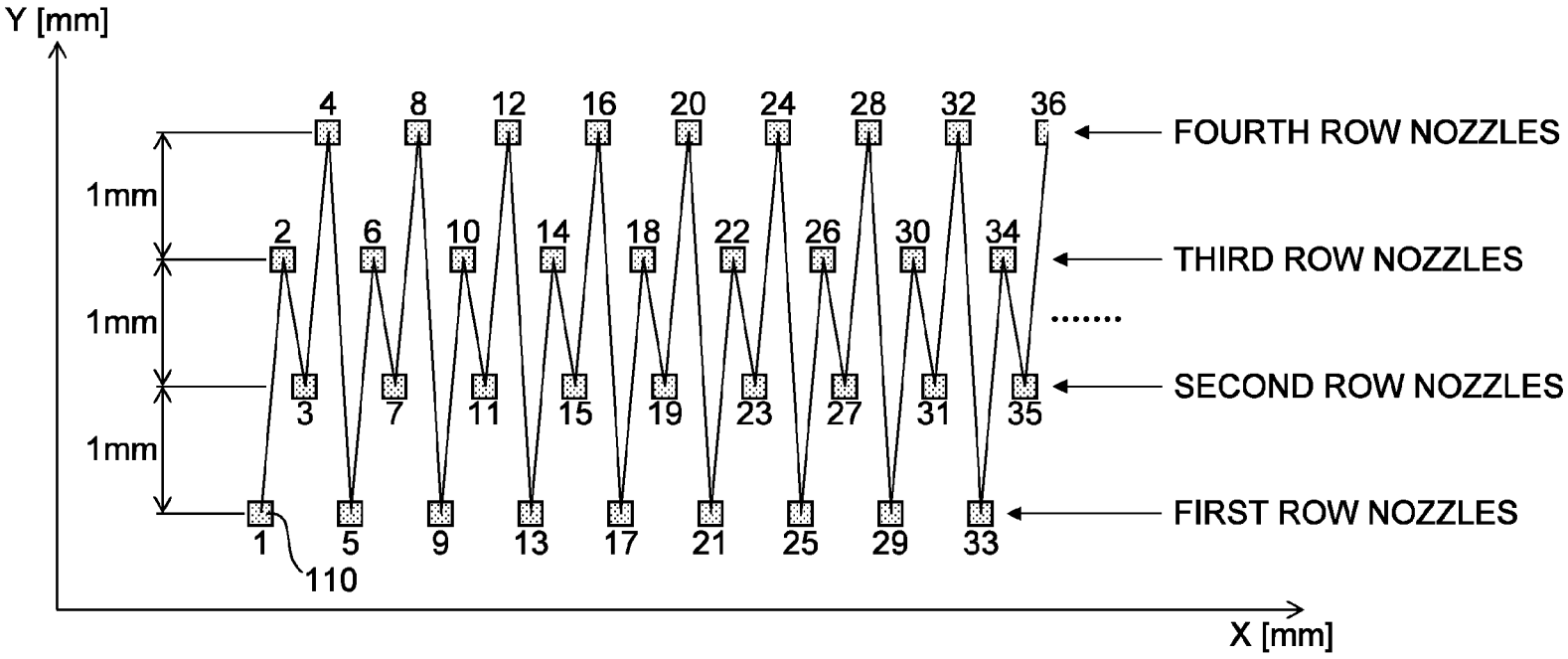
FIG. 4 is an enlarged view of a nozzle array in a matrix shown in FIG. 3.

FIG. 4 is an enlarged view of the nozzle array in a matrix shown in FIG. 3. Each of black solid tetragons in FIG. 4 represents the nozzle position and a numeral designating the nozzles 110 is the nozzle number. The nozzle number is a number identifying each nozzle. The nozzle number is given in accordance with an order in an alignment on the X-axis obtained by projecting X coordinates of the nozzles 110 to the X-axis. In FIG. 4, for the purpose of ease of description, a leftmost nozzle 110 in FIG. 4 is given the nozzle number of No. 1. Note that an origin of the XY coordinates of the X-axis and Y-axis may be arbitrarily set, but the position of the center of gravity in the nozzle array in a matrix is set for the origin in the example for the purpose of ease of calculation.

In the nozzle array in a matrix shown in FIG. 4, the lowermost nozzle row is defined as a "first row", and row numbers are defined in an order of a second row, a third row, and a fourth row upward in FIG. 4 from the first row. The nozzles belonging to the first row are referred to as "first row nozzles". Similarly, the nozzles belonging to the second row are referred to as "second row nozzles", the nozzles belonging to the third row are referred to as "third row nozzles", and the nozzles belonging to the fourth row are referred to as "fourth row nozzles".

Each nozzle row has the nozzles 110 aligned therein at the nozzle density at 300 npi. If the X coordinates of the nozzles 110 are projected to the X-axis, the nozzles 110 are positioned on the X-axis at the nozzle density of 1200 npi. A distance between the nozzle rows in the Y direction is assumed to be 1 millimeter (mm) for the sake of calculation.

[Explanation of Measurement Method of Deposit Displacement Amount for Each Nozzle]

Next, a description is given of a method for measuring the deposit displacement amount for each nozzle from the printed result of the nozzle state check pattern. The nozzle state check pattern is a test pattern for detecting an ejection defective nozzle and is equivalent to a "defective nozzle detection test pattern".

Figure 5:
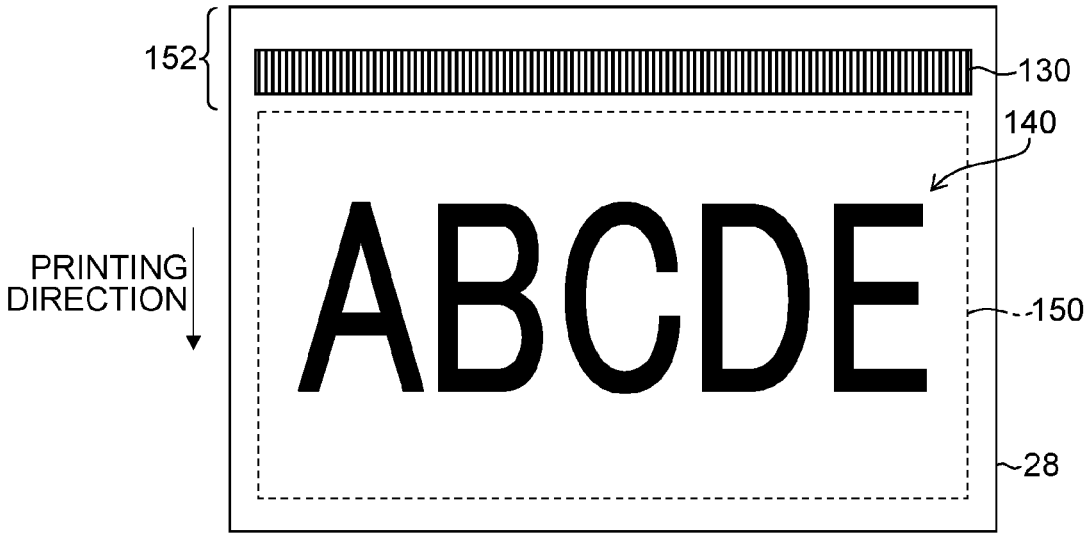
FIG. 5 is an illustration showing an example of a printed matter on which a nozzle state check pattern is recorded for examining an ejection condition for each nozzle.

FIG. 5 is an illustration showing an example of a printed matter on which the nozzle state check pattern is recorded for examining an ejection condition for each nozzle. In order to determine whether or not the nozzles 110 of the head unit 56 can be used for printing, the nozzle state check pattern 130 is printed on the recording medium 28, the printed result of the nozzle state check pattern 130 is read by the inline sensor 58 (see FIG. 1), and the ejection conditions of the nozzles 110 are examined from the obtained read image. The "ejection condition" includes at least the ejection direction of the nozzle (that is, a liquid droplet flying direction). The ejection direction of the nozzle is referred to as "ejection bending" in some cases. The ejection direction of the nozzle can be grasped from the depositing position where the liquid droplet ejected from the nozzle is deposited on the recording medium, that is, the dot forming position. Therefore, the examination of the ejection direction can be replaced with the examination of the depositing position to be understood. The "ejection condition" can also include at least one of whether or not to eject and an ejected liquid droplets amount.

The recording surface of the recording medium 28 has an image printed area 150 where an image to be printed 140 is recorded, and a space area 152 which is an area outside the image printed area 150. The nozzle state check pattern 130 shown in FIG. 5 is printed on the space area 152 on the leading end side in the recording medium conveying direction of the recording surface of the recording medium 28. Conveying the recording medium 28 to the inkjet head 100 causes relative movement between the inkjet head 100 and the recording medium 28. In a case of the inkjet print device 10 using a full-line type line head, the conveying direction of the recording medium 28 corresponds to a direction of the relative movement between the inkjet head 100 and the recording medium 28.

The relative movement between the inkjet head 100 and the recording medium 28 and the ink ejection from the inkjet head 100 allow printing on the recording surface of the recording medium 28. A printing direction indicated by a downward arrow in FIG. 5 is a direction in which the print progresses with the relative movement between the recording medium 28 and the inkjet head 100, and is opposite to the recording medium conveying direction. In the example in FIG. 5, in order to evaluate the ejection performance of the inkjet head 100 in operation of the inkjet print device 10, a configuration is used in which the nozzle state check pattern 130 is printed on the space area 152 on the leading end side of the recording medium 28 and the image to be printed 140 is printed on the image printed area 150 of the recording medium 28, but the image to be printed 140 may not be printed on the recording surface of the recording medium 28 but only the nozzle state check pattern 130 may be printed.

Based on the read image data obtained by reading the printed result of the nozzle state check pattern 130 by the inline sensor 58, the deposit displacement for each nozzle 110 in the X direction (that is, ejection straightness) can be measured, and a distance in the X direction between the dot forming positions adjacent to each other in the X direction can be calculated. The dot forming position by means of each nozzle of the inkjet head is a position of the dot which the inkjet head can record on the recording medium, that is, a "position of a pixel" on the recording medium. The distance in the X direction between the dot forming positions adjacent to each other means a distance to the next pixel in the X direction. The distance in the X direction between the dot forming positions adjacent to each other is referred to as a "distance between the adjacent pixels". In a case where a position of each nozzle of the inkjet head is transformed into a position on the X-axis that is one of the coordinate systems, the nozzles adjacent to each other in an array of nozzles which are aligned in a line on the X coordinate system after transformation is referred to as "adjacent nozzles".

Figure 6:
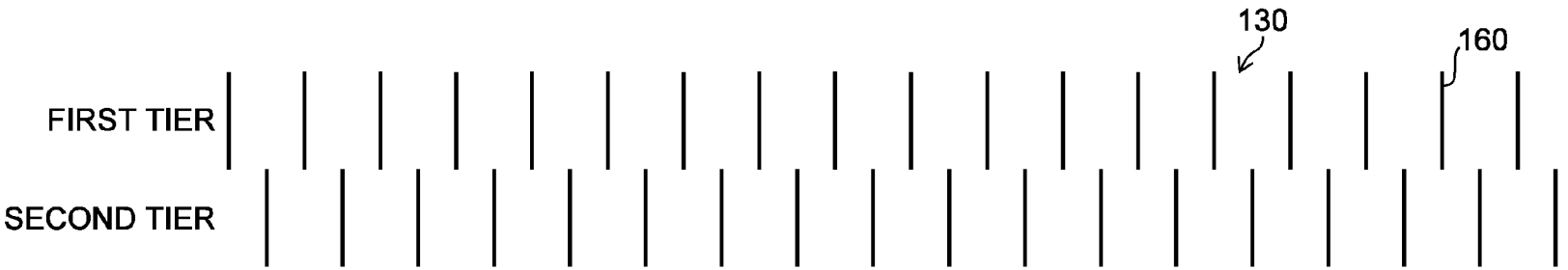
FIG. 6 is an illustration showing an example of a nozzle state check pattern.

FIG. 6 is an example of the nozzle state check pattern 130. FIG. 6 is a diagram where the nozzle state check pattern 130 with the number of divisions of two is created. In the embodiment, the number of divisions of k is referred to a case where a division patterns are formed at an interval of (k−1) nozzle lines in the X direction. Reference character k represents an integer equal to or more than 2. The nozzle state check pattern 130 shown in FIG. 6 is an example of a two-division pattern in which the all nozzles 110 contained in the inkjet head 100 are divided into two groups and the line pattern is recorded in a unit of the group. A block of the line pattern shown in the upper tier in FIG. 6 is called a first tier and a block of the line pattern shown in the lower tier is called a second tier. In the embodiment, since the inkjet head 100 of 1200 dpi is used (see FIG. 3 and FIG. 4), in the case of the two-division pattern shown in FIG. 6, lines 160 are aligned in one tier at 600 dpi. In the case of FIG. 6, the lines 160 each having the nozzle number of odd number are aligned in the first tier and the lines 160 each having the nozzle number of even number are aligned in the second tier.

As the liquid droplets of ink are ejected from the nozzles 110 of the inkjet head 100 and the recording medium 28 is conveyed, the liquid droplets of ink are deposited on the recording medium 28 and the lines 160 are printed each as a dot row in which the dots by the deposited ink are continuously aligned in the Y direction as in FIG. 6. In this way, the line 160 recorded by each nozzle 110 is a line segment having a predetermined length of one dot row in the Y direction which is recorded by way of continuous droplet ejection by one nozzle 110. The line segment of one dot row in the Y direction which is formed by one nozzle in the nozzle state check pattern 130 is called a "nozzle line" or simply a "line".

In a case of using the inkjet head 100 of high recording density, if the droplets are simultaneously ejected from the all nozzles 110, the dots from the adjacent nozzles partially overlap each other such that the line of one dot row is not formed. In order to prevent the lines 160 formed by the droplet ejection from the nozzles 110 from overlapping each other, it is desirable to arrange the simultaneously ejecting nozzles at an interval by at least one nozzle, preferably by three or more nozzles. The appropriate number of divisions is set depending on the recording resolution of the inkjet head 100 of use.

The nozzle state check pattern 130 is illustrated in FIG. 6 with the number of divisions of two for the purpose of ease of description, but the printed lines overlap each other depending on the recording resolution of the inkjet head 100 if the number of divisions is too small, and therefore, the deposit displacement may not be measured in some cases. Moreover, if the number of divisions is too increased, a printed range for the nozzle state check pattern 130 elongates. For this reason, the number of divisions k is defined as an appropriate value from the point of view that the adjacent lines 160 are prevented from overlapping each other and the printed range for the nozzle state check pattern 130 on the recording medium 28 is made to fall within a proper size.

Figure 7:
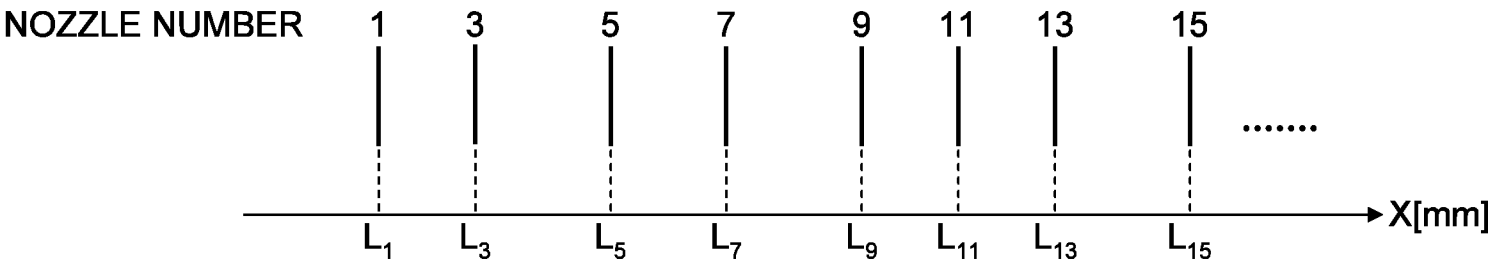
FIG. 7 is an explanatory illustration of a line group extracted from a first tier in the nozzle state check pattern shown in FIG. 6.

FIG. 7 shows a line group extracted from the first tier in the nozzle state check pattern 130 having the number of divisions of two shown in FIG. 6. The line group shown in FIG. 7 has lines therein aligned with a line gap equivalent to 600 dpi (about 42 micrometers (μm)) therebetween. A nozzle number i of the nozzle printing a line is defined such that a positional coordinate of the line in the X direction is $L_i$. Reference character i representing the nozzle number is an integer equal to or more than 1. A positional coordinate of a line recorded by a nozzle of the nozzle number 1 is designated by $L_1$, a positional coordinate of a line recorded by the nozzle of a nozzle number 3 is designated by $L_3$, a positional coordinate of a line recorded by a nozzle of the nozzle number 5 is designated by $L_5$, a positional coordinates of a line recorded by a nozzle of the nozzle number 7 is designated by $L_7$, and so on. In FIG. 7, the positional coordinates of the lines of the nozzle numbers 1 to 15 are shown for the purpose of ease of illustration.

By scanning the printed nozzle state check pattern 130 by the inline sensor 58 and analyzing the obtained read image, print positions of the lines 160, that is, the positional coordinates of the lines 160 can be found. The positional coordinates of the lines 160 are referred to as "line coordinate". A suffix i of the line coordinate $L_i$ is called a line number. The line number is equal to the nozzle number of the nozzle 110 recording the line 160 at the line coordinate $L_i$.

Figure 8:
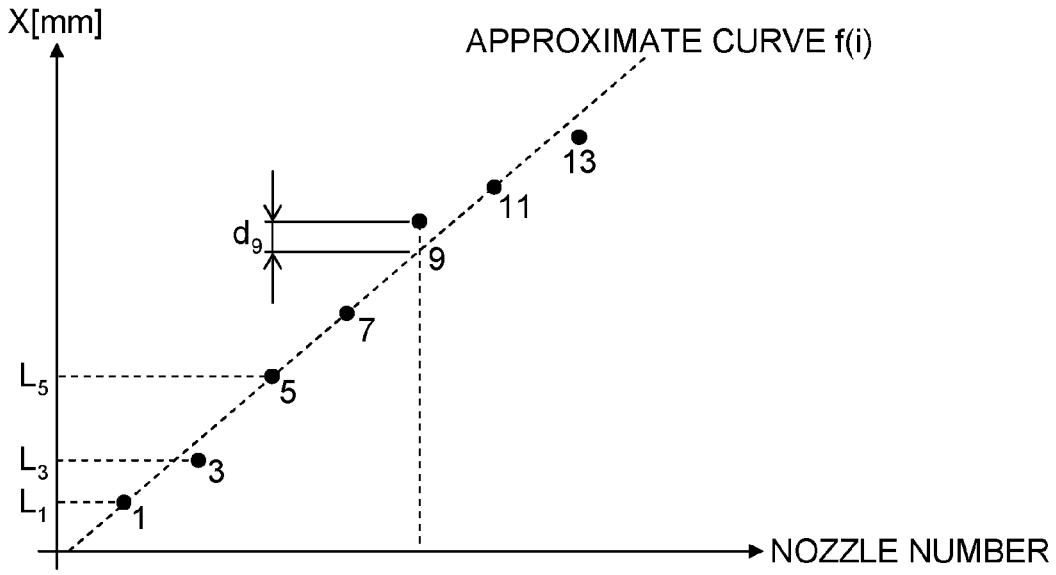
FIG. 8 is a graph showing an example of an approximate curve calculated based on measured data of line positions.

An approximate curve f(i) as shown in FIG. 8 can be drawn from the line coordinates of the lines shown in FIG. 7. As shown in FIG. 8, the nozzle number i is taken as an abscissa and the line coordinate $L_i$ is taken as an ordinate, and the approximate curve f(i) can be drawn from a set of measured data (i, $L_i$) which is found from the read image of the printed result of the nozzle state check pattern 130.

In the embodiment, assuming that the approximate curve f(i) is obtained by creating a one-dimensional approximate curve by use of 20 lines respectively on both sides of a nozzle whose deposit displacement amount is wanted to be measured. Of course, the approximate curve may be two- or more-dimensional curve.

A deposit displacement amount $d_i$ for each line number i can be calculated by means of Formula (1) as below.

$$d_i = L_i - f(i) \qquad \text{Formula (1)}$$

In accordance with Formula (1), the deposit displacement amounts $d_1$, $d_3$, $d_5$, $d_7$, . . . of the nozzles can be calculated. FIG. 8 shows a deposit displacement amount $d_9$ for a line number 9.

As for the second tier also, the deposit displacement amounts $d_2$, $d_4$, $d_6$, $d_8$ . . . can be calculated similarly to the first tier.

In this way, the deposit displacement amounts for two tiers in the two-division pattern are respectively calculated and the obtained data is merged to allow the deposit displacement amounts of the all nozzles to be calculated. This can be also applied to the case of the number of divisions more than two to allow the deposit displacement of the all nozzles to be calculated in the same way. The point to note in this method is that the adjacent nozzle numbers belong to different tiers in the division pattern and calculation results of respective tiers are merged.

Note that in FIG. 8 the measurement method of the deposit displacement is described concerning the tier in the division pattern with a regular pitch, but the deposit displacements of the nozzles even for the division pattern with an irregular pitch can be measured by the same method. This is because, in a case of the division pattern with the irregular pitch, as compared with the case of the regular pitch illustrated in FIG. 8, the nozzle number taken as the abscissa is merely not the regular pitch (is the irregular pitch) and the approximate curve can be calculated.

[Distance Between Lines of Adjacent Nozzle Numbers]

Here, considered is an X direction distance between the lines of the adjacent nozzle numbers in the nozzle alignment arranged in the X direction at 1200 npi. Since the line coordinate $L_i$ of the nozzle number i represents the dot forming position of the nozzle of the nozzle number i in the X direction, the X direction distance between the lines of the adjacent nozzle numbers is an X direction distance between adjacent pixels corresponding to the adjacent nozzle numbers, that is, a distance between the adjacent pixels.

An ideal pixel pitch $P_{ideal}$ when the recording resolution is 1200 dpi is $P_{ideal}$=25.4 (mm)/1200 (dpi)=21.2 (μm). Assuming the X direction distance between the nozzle number i and the nozzle number i+1 is defined as $P_i$, Formula (2) below is obtained.

$$P_i = P_{ideal} + d_{i+1} - d_i \qquad \text{Formula (2)}$$

[Determination Method to be Normal or Abnormal]

If $P_i$ is smaller, an image is darkened to generate a black streak. On the other hand, if $P_i$ is larger, an image is lightened to generate a white streak. Therefore, an upper limit and a lower limited are set to a normal range of $P_i$, for example, such that abnormality of the streak generation can be detected. An example of the upper limit and the lower limit set to the normal range of $P_i$, the normal range of $P_i$ may be 10.2 μm<$P_i$<26.2 μm.

The smaller distance $P_i$ involving the black streak is not so distinct, but the larger distance $P_i$ involving the white streak is distinct, and therefore, the upper limit is more strictly defined than the lower limit concerning the setting of the normal range of $P_i$. The normal range dealing with $P_i$ as being normal may be changed as needed depending on an image level required for the inkjet print device. The "normal range" corresponds to an aspect of a "prescribed acceptable range".

When the distance $P_i$ between the pixels of the abnormal adjacent nozzles which is out of a predefined normal range is detected, of the nozzle of the nozzle number i and the nozzle of the nozzle number i+1 which define the distance $P_i$ between those pixels of the abnormal adjacent nozzles, the nozzle having larger one of absolute values of the deposit displacement amounts $|d_i|$ and $|d_{i+1}|$ is determined to be "abnormal". Then, the defective nozzle determined to be "abnormal" is not used for printing, and ejection amounts from the nozzles of the nozzle numbers which are on both side of the nozzle number of the defective nozzle are adequately increased to enable the streak to be indistinct. The correction process like this is referred to as a "non-ejection correction".

Further, the ejection amount where $P_i$ is smaller may be decreased and the ejection amount where $P_i$ is larger may be increased to reduce visibility of the streak. The correction process like this is referred to as a "printing density unevenness correction".

If the number of the adjacent nozzles where $P_i$ is determined to be abnormal is increased, head maintenance is performed such that the ejection performance can be recovered and a clean printed imaged can be obtained. The head maintenance is also referred to as head cleaning. The head maintenance may include at least one of sucking the nozzle, auxiliary ejection, and wiping the nozzle surface, for example.

[Explanation of Problem]

The above described measurement method of the deposit displacement amount $d_i$ has problems as below. That is, in the method of calculating and merging the deposit displacement amount for each tier in the division pattern, if θz is not zero, that is, if the inkjet head 100 has the angle deviation in the rotation direction about the Z-axis, a distance to the next line cannot accurately measured in some cases.

In the matrix head of 1200 npi, the pitch of the nozzles which are otherwise (in the case of θz=0) aligned at the regular pitch of 21.2 micrometers (μm) may be smaller in some locations and larger in other locations than 21.2 micrometers in the case of θz≠0.

Figure 9:
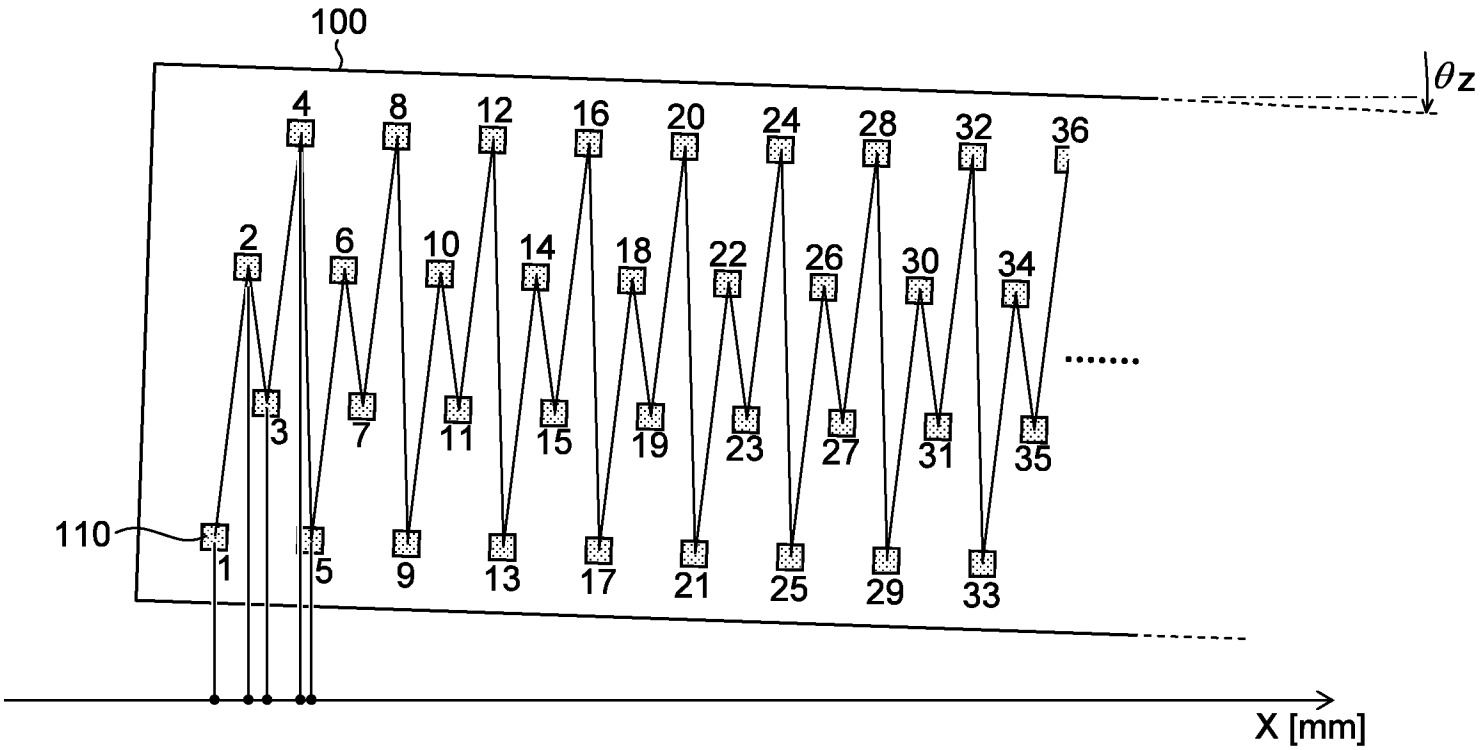
FIG. 9 is an explanatory illustration of nozzle positions in a case where the nozzle array shown in FIG. 4 is rotated.

FIG. 9 is an explanatory illustration of the nozzle positions in a case where the nozzle array shown in FIG. 4 is rotated by θz<0. As is clear from FIG. 9, an X direction interval between the nozzle number 1 and the nozzle number 2 is larger than the case in FIG. 4 (θz=0), and the X direction interval between the nozzle number 2 and the nozzle number 3 in FIG. 9 is smaller than the case in FIG. 4. Further, the X direction interval between the nozzle number 3 and the nozzle number 4 in FIG. 9 is larger, and the X direction interval between the nozzle number 4 and the nozzle number 5 is smaller.

Figure 10:
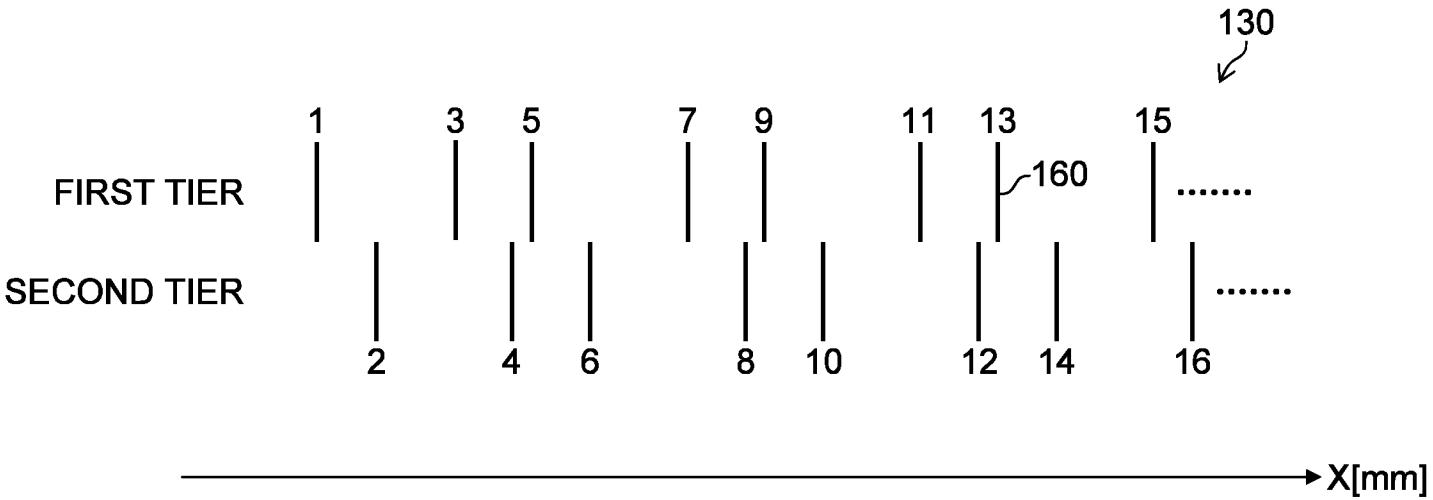
FIG. 10 is an illustration showing an example in case where the nozzle state check pattern is printed in a state where the inkjet head is rotated.

FIG. 10 is an example in which the nozzle state check pattern 130 with the number of divisions of two is printed in a state where the inkjet head 100 illustrated in FIG. 3 and FIG. 4 is rotated by θz<0. The numerals 1 to 16 designating the lines 160 are the nozzle numbers of the nozzles recording the respective lines 160.

The first tier in the nozzle state check pattern 130 shown in FIG. 10 is constituted by the lines 160 of the first row nozzles and second row nozzles. In other words, the first tier is recorded only by the first row nozzles and second row nozzles corresponding to lower half in FIG. 4 of the nozzle array having four rows in total. The second tier is constituted by the lines 160 of the third row nozzles and fourth row nozzles. In other words, the second tier is recorded only by the third row nozzles and fourth row nozzles corresponding to upper half in FIG. 4 of the nozzle array having four rows in total.

Assume that the rotation angle θz is −4 milliradians (mrad) as an example. FIG. 10 emphatically shows a line displacement for the purpose of easy understanding.

Figure 11:
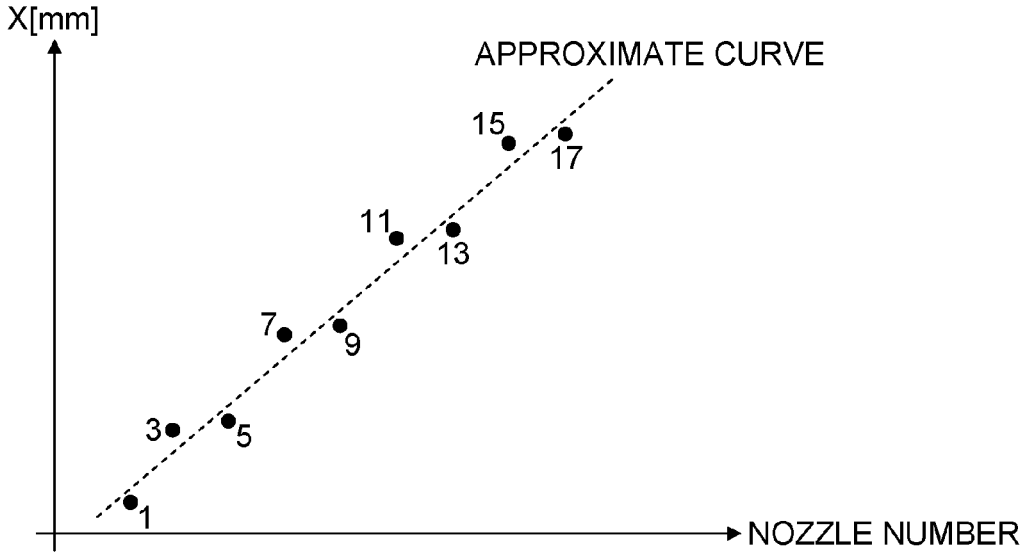
FIG. 11 is a graph showing a relationship between a nozzle number and a line coordinate of each line with which a first tier in the nozzle state check pattern shown in FIG. 10 is configured.

FIG. 11 is a graph showing a relationship between the nozzle number and the line coordinate of each line with which the first tier in the case of θz<0 shown in FIG. 10 is configured. As illustrated in FIG. 8, when the approximate curve is found based on a measurement result of the nozzle state check pattern in FIG. 10, an approximate curve as shown in FIG. 11 can be drawn. A difference between the approximate curve found in this way and an actual line coordinate is calculated as the deposit displacement amount. As a result, the deposit displacement amount has a value containing a component caused by the rotation by θz as shown in FIG. 12.

Figure 12:
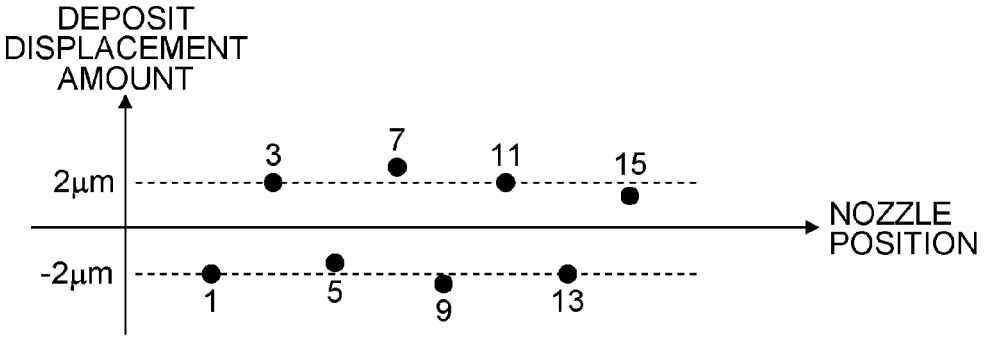
FIG. 12 is a graph collectively showing deposit displacement amounts of the nozzles found from a line pattern of the first tier in FIG. 10.

FIG. 12 is a graph collectively showing the deposit displacement amounts of the nozzles found from the line pattern of the first tier in FIG. 10. An abscissa in FIG. 12 represents the position of the nozzle and an ordinate represents the deposit displacement amount. In the example, since an absolute value of a rotation amount of the angle is 4 milliradians (mrad) and a Y direction distance between the nozzles of the first row nozzle and the second row nozzle is 1 millimeter (mm) (see FIG. 4), the deposit displacement amounts of the nozzles are about ±2 micrometers (μm) deviation with an average being zero. The deposit displacement amount measured from the printed result of the nozzle state check pattern 130 is not only systematically affected due to the angle deviation of θz but also affected by random positional displacement which is intrinsic to the nozzle.

Figure 13:
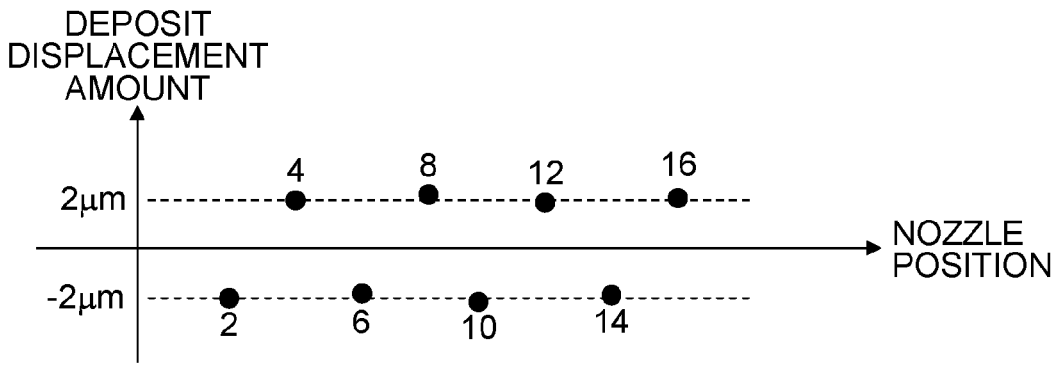
FIG. 13 is a graph collectively showing deposit displacement amounts of the nozzles found from a line pattern of a second tier in FIG. 10.

If the second tier is calculated similarly to the first tier, the same result is obtained as in FIG. 13. FIG. 13 is a graph collectively showing the deposit displacement amounts of the nozzles found from the line pattern of the second tier in FIG. 10.

The distance $P_i$ between the nozzles of the adjacent nozzle numbers in the X direction is calculated from the results in FIG. 12 and FIG. 13 to make the problem clear. For example, if the distance $P_6$ between the nozzle number 7 and the nozzle number 6 is P_ideal=21.2 micrometers (μm), and the influence due to the individual nozzles random positional displacements is eliminated, the result is as below.

$$P_6=21.2+d_7-d_6\approx 21.2+2-(-2)=25.2(\mu m) \quad \text{Formula (3)}$$

However, as is clear from FIG. 9, it can be seen that concerning a relative moving amount between the nozzle number 6 and the nozzle number 7 in X direction due to the θz rotation, these nozzles are naturally rather toward close to each other.

For example, the nozzle number 7 is rotated about the nozzle number 6 by θz=−4 milliradians (mrad), the nozzle number 7 moves in the X direction by about −4 micrometers (μm). In other words, $P_6$ is naturally to be 21.2 μm−4 μm=17.2 μm.

The result "$P_6$=25.2 μm" calculated in the method of related art as in Formula (3) is entirely different from "17.2 μm", and thus, if the result of the deposit displacement calculated in the method of related art is used for the abnormality determination or the correction process described above, the result thereof may possibly have a large error.

The reason for having the large error like this is reviewed as follows.

In a case of the method in which the approximate curve f(i) illustrated in FIG. 8 is used to measure the deposit displacement amount of a nozzle of interest in terms of conditions of near lines, the approximate curve is created in such a manner that an average value is to be zero of the deposit displacement amounts of the nozzles which are used for a calculation for finding that approximate curve. Therefore, if there is the θz rotation of the inkjet head, the rotation is calculated as a behavior in which as a rotation center, a center of gravity of a plurality of nozzles used for a calculation for finding the deposit displacement amount of the nozzle of interest is used. For example, the approximate curve is created from the line group of the first tier in FIG. 10, the second row nozzles are dealt with as if the nozzles move in a positive direction in of X-axis in terms of the calculation.

However, actually, as seen in FIG. 9, in a case where θz is a negative direction rotation angle, if an average value of nozzle moving amounts of the whole head is zero, as for the second row nozzles, the nozzles move in the negative direction of the X-axis.

[Example of Solution for the Problem]

One of solutions for the above problem is to devise a form of the nozzle state check pattern in terms of the nozzle array form in the inkjet head. For example, the nozzle state check pattern capable of solving the problem is configured to have patterns divided into two or more line groups in the Y direction, of which line groups at least plural lines used for calculating the deposit displacement amount of the nozzle of interest are aligned at a regular pitch of the number of divisions k, and the number of the nozzle rows $N_r$ and the number of divisions k are coprime to each other. The number of the nozzle rows is referred to the number of the nozzle alignments in the Y direction in the nozzle array in a matrix. The nozzle state check pattern having such a configuration is used to calculate the deposit displacement amount of the nozzle of interest so that the deposit displacement amount can be calculated which accurately contains the influence due to the angle deviation θz of the inkjet head.

First Embodiment

Figure 14:
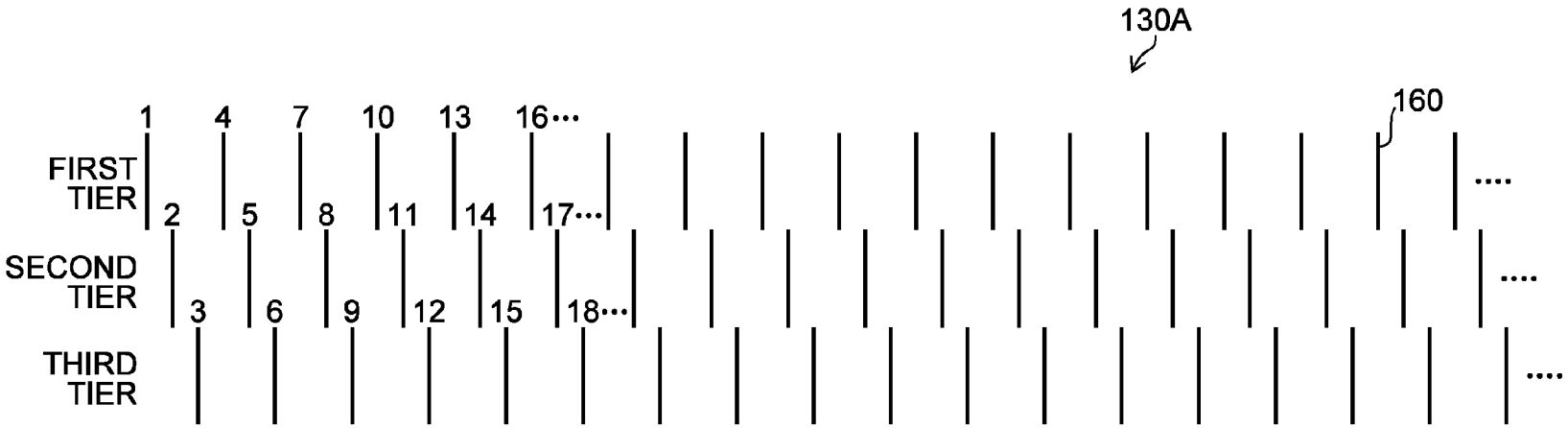
FIG. 14 is an illustration showing an example of a nozzle state check pattern according to a first embodiment of the invention.

FIG. 14 is an illustration showing an example of the nozzle state check pattern 130A according to a first embodiment of the invention. FIG. 14 is an example of a nozzle state check pattern 130A with a regular pitch of the number of divisions k=3. The nozzle state check pattern 130A shown in FIG. 14 is drawn by use of the matrix head having the nozzle array illustrated in FIG. 4.

The nozzle numbers of the nozzles for recording a line group of each of a first tier, a second tier, and a third tier in the nozzle state check pattern 130A shown in FIG. 14 is as below. The nozzle numbers of the nozzles for recording the line group of the first tier are 1, 4, 7, 10, 13, 16 and so on. The nozzle numbers of the nozzles for recording the line group of the second tier are 2, 5, 8, 11, 14, 17 and so on. The nozzle numbers of the nozzles for recording the line group of the third tier are 3, 6, 9, 12, 15, 18 and so on.

In the nozzle state check pattern with the regular pitch of the number of divisions k, the nozzle numbers of the nozzles recording for a line group of a s-th tier can be represented as below.

$$\text{The nozzle number}=k\times u+s \qquad \text{Formula (4)}$$

The character s represents a natural number from 1 to k. The character u represents an integer equal to or more than 0 (u=0, 1, 2, . . . ). Note that the "tier" in the nozzle state check pattern is a block of the line group which is divided in the Y direction to be recorded, and is referred to a band-like area where a plurality of lines are aligned in the X direction.

Figure 15:
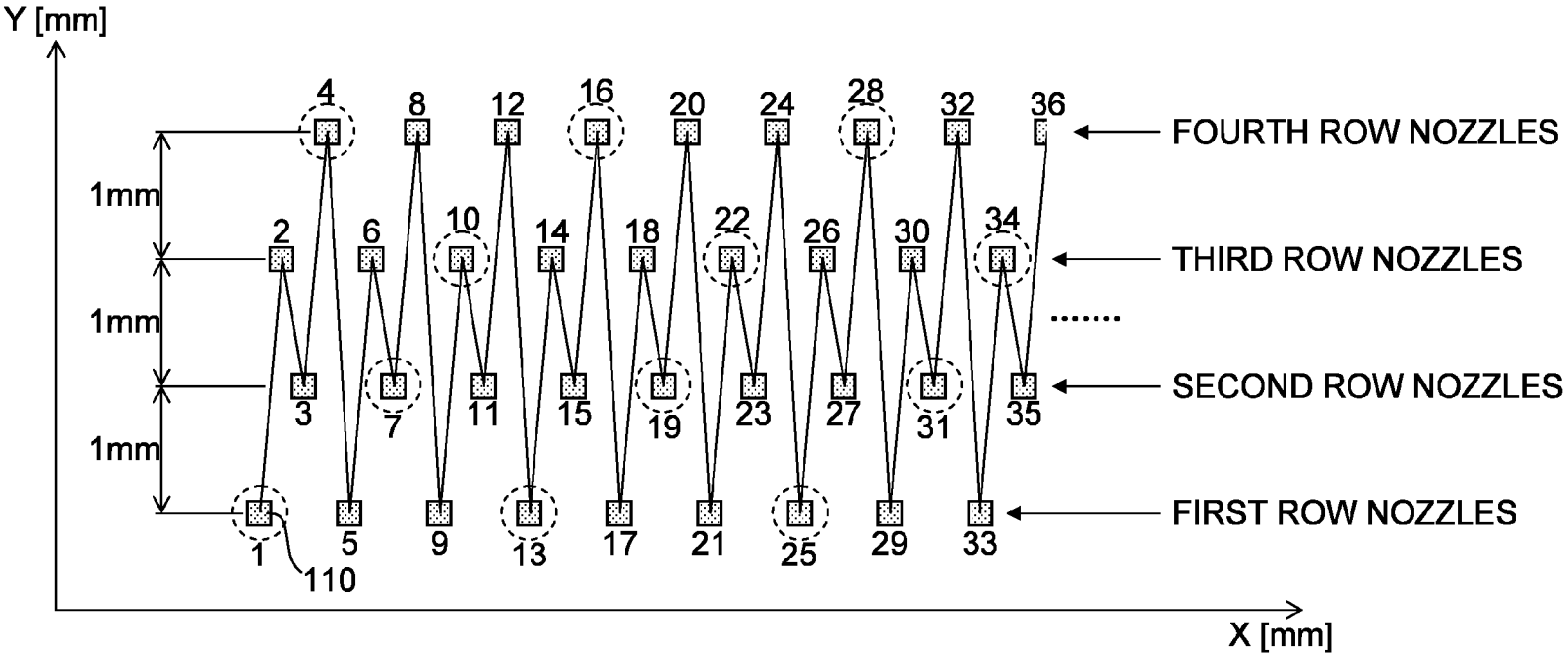
FIG. 15 is an enlarged view of the nozzle array in a matrix, in which the nozzles recording lines constituting a first tier in the nozzle state check pattern in FIG. 14 are each surrounded by a dotted line.

FIG. 15 is an explanatory illustration of the nozzles, each of which is surrounded by a dotted line, which record the lines constituting the first tier in the nozzle state check pattern 130A with the regular pitch of the number of divisions k=3 in the nozzle array shown in FIG. 14.

As is clear from FIG. 15, the nozzle numbers of the nozzles recording the lines constituting the first tier in the nozzle state check pattern 130A (see FIG. 14) evenly exist at a regular interval (regular pitch) in the X direction of the nozzle array in a matrix, and evenly exist across the nozzle rows also in the Y direction. Of course, the nozzle numbers constituting the second tier in the nozzle state check pattern 130A (see FIG. 14) and the nozzle numbers constituting the third tier similarly evenly exist at a regular interval (regular pitch) in the X direction, and evenly exist across the nozzle rows also in the Y direction.

The nozzle array in this example has the number of the nozzle rows $N_r$=4. The number of divisions k=3 and the number of the nozzle rows $N_r$=4 of the nozzle state check pattern 130A shown in FIG. 14 are coprime to each other.

In a case of the number of the nozzle rows $N_r$=4, so long as the number of divisions k=3, 5, 7, 9, 11, 13 and so on holds, the number of divisions k is "coprime to" the number of the nozzle rows $N_r$. Although conformation by way of showing a figure is omitted, if the number of the nozzle rows $N_r$ is coprime to the number of divisions k, in the line group of each the tier in the nozzle state check pattern, the nozzle numbers constituting each tier are evenly selected from the all nozzle rows in the nozzle array of the inkjet head.

In other words, in the case of the nozzle state check pattern with the regular pitch of the number of divisions k, a nozzle group performing the recording of the line group of each tier evenly includes the nozzles in the all nozzle rows. The phrase "evenly includes the nozzles in the all nozzle rows" means that the equivalent number of the nozzles in the all nozzle rows is included in each nozzle group, and the "equivalent number" permits and error of "±1".

A description is given in further detail using a concrete example.

Assume that the nozzle number of the nozzle whose deposit displacement amount is to be calculated is a nozzle number n. In a case of carrying out calculation of the deposit displacement amount of the nozzle of the nozzle number n from the read image of the nozzle state check pattern, as is described, in the line group of the tier to which belongs the line recorded by the nozzle number n in the nozzle state check pattern, 20 nozzles respectively on both sides of the nozzle number n, that is, 40 nozzles in total are used to find the approximate curve, and a deposit displacement amount dn of the nozzle number n is calculated from this approximate curve and information on the depositing position of the nozzle number n.

The nozzles used for finding the approximate curve correspond to the nozzles used for calculation for finding the deposit displacement amount of the nozzle number n. In other words, 40 nozzles" used for calculating the approximate curve in the embodiment correspond to an example of a nozzle used for calculation used for calculation for finding the deposit displacement amount of the nozzle number n. The number of the nozzles used for calculation is not limited to "40", and may be designed to have an adequate value with calculation accuracy and calculation processing time taken into account.

The coordinates of a center of gravity of 40 nozzles used for calculating the deposit displacement amount dn of the nozzle number n may be represented as below.

$$\text{Center of gravity in the } X \text{ direction} = \Sigma_A x_i/40 \qquad \text{Formula (5)}$$

$$\text{Center of gravity in the } Y \text{ direction} = \Sigma_A y_i/40 \qquad \text{Formula (6)}$$

The character $x_i$ is an X coordinate representing a position of a nozzle of a nozzle number i in the X direction. The character $y_i$ is a Y coordinate representing a position of the nozzle of the nozzle number i in the Y direction. The character "$\Sigma_A$" represents a sum concerning the nozzles used for calculation (40 nozzles in this example) used for calculation for finding the deposit displacement amount of the nozzle number n. The center of gravity in the X direction is equivalent to the position of the center of gravity in the X direction and is an X coordinate of the center of gravity. The center of gravity in the Y direction is equivalent to the position of the center of gravity in the Y direction and is a Y coordinate of the center of gravity.

In the case of the nozzle array shown in FIG. 4, it is clear that the position of the center of gravity in the Y direction of 40 nozzles used for calculation is at the center of the second row nozzles and the third row nozzles.

Note that as the nozzles used for finding the approximate curve, 41 nozzles in total may be used including the nozzle of the nozzle number n in addition to the above "40 nozzles". In this case, denominators in Formula (5) and Formula (6) are 41, but even if the denominator is 41, a difference is merely several percentages as compared to the case where the denominator is 40.

On the other hand, in the range of 20 nozzles respectively on both sides of the nozzle number n, that is, 40 nozzles in total, there are about 120 nozzles including other tiers not used for calculating the approximate curve in the case of the number of divisions k=3. The coordinates of a center of gravity of these 120 nozzles may be represented as below.

$$\text{Center of gravity in the } X \text{ direction} = \Sigma_B x_i/120 \qquad \text{Formula (7)}$$

$$\text{Center of gravity in the } Y \text{ direction} = \Sigma_B y_i/120 \qquad \text{Formula (8)}$$

The character "$\Sigma_B$" represents a sum concerning all nozzles (120 nozzles, here) existing in the nozzle range of the nozzles used for calculation used in calculating the approximate curve for finding the deposit displacement amount of the nozzle number n.

In the case of the nozzle array shown in FIG. 4, it is clear that the center of gravity of these 120 nozzles in the Y direction is at the center of the second row nozzles and the third row nozzles.

Note that in finding the approximate curve, similarly to the case of 41 nozzles in total including the nozzle of the nozzle number n in addition to the above described "40 nozzles", "121 nozzles" in total may be used including the nozzle of the nozzle number n in addition to the number of all nozzles existing in the nozzle range of the nozzles used for calculation. In this case, denominators in Formula (7) and Formula (8) are 121, but even if the denominator is 121, an error is merely one or less percentage.

In the case of this example, the coordinates of the center of gravity of the nozzles constituting the first tier in the nozzle state check pattern 130A coincide with the center of gravity of all nozzles existing near. Similarly, the coordinates of the center of gravity of the nozzles constituting the second tier in the nozzle state check pattern 130A and the coordinates of the center of gravity of the nozzles constituting the third tier also each coincide with the center of gravity of all nozzles existing near.

In other words, if such a relationship is met, a behavior due to the head rotation with respect to the nozzles constituting the line group of each tier in the nozzle state check pattern 130A coincides with a behavior actually wanted to be known of the all nozzles rotating. Therefore, the deposit displacement amount which accurately takes the influence due to the angle deviation θz can be calculated from measured data of the line groups of the tiers in the nozzle state check pattern 130A.

Note that as described later, the moving amount of the nozzle in the X direction with respect to the θz rotation of the inkjet head 100 largely depends on only the Y coordinate of that nozzle and may be considered with the coordinate in the X direction being ignored.

Then, Formula (5) and Formula (7) may be ignored and at least Formula (6) and Formula (8) may be consistent with each other. In other words, in a certain tier in the nozzle state check pattern, assuming that the number of the nozzles existing in in a range for drawing the approximate curve is $N_A$ and the number of the all nozzles including the nozzles not used for calculation in the range is $N_B$, at least Formula (9) may hold.

$$\Sigma_B y_i/N_B \approx \Sigma_A y_i/N_A \qquad \text{Formula (9)}$$

Furthermore, besides a condition of Formula (9), it is preferable that Formula (10) regarding the X direction holds as below.

$$\Sigma_B x_i/N_B \approx \Sigma_A x_i/N_A \qquad \text{Formula (10)}$$

However, since the moving amount of the nozzle in the X direction with respect to the θz rotation is little affected by the X coordinate of the nozzle, Formula (10) is not so necessarily given weight.

The sign "≈" in Formula (9) and Formula (10) represents being approximately equivalent including a range of a permissible error.

Figure 16:
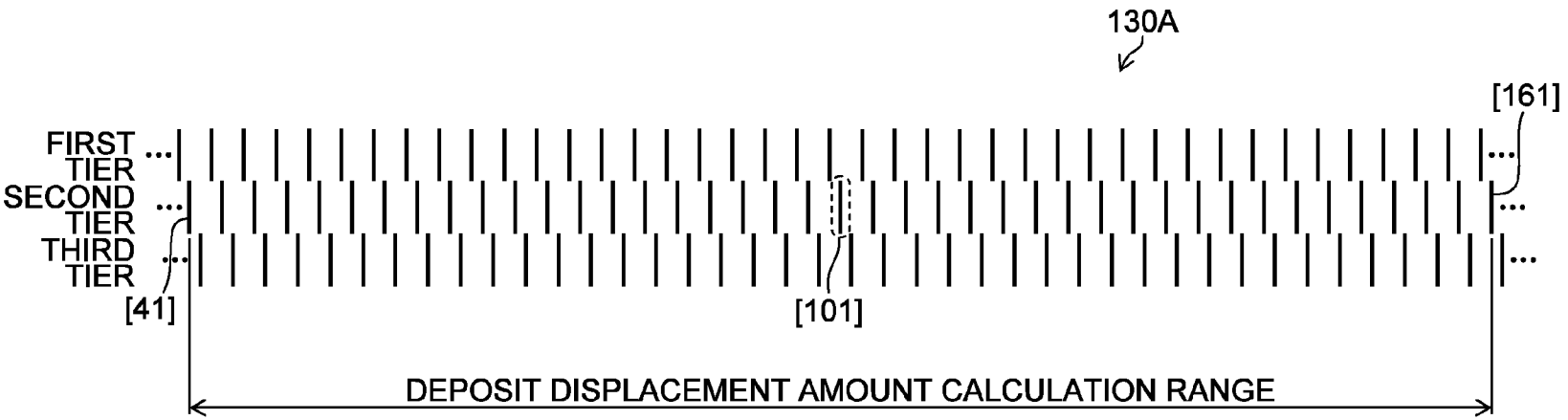
FIG. 16 is an explanatory illustration in a case where a deposit displacement amount of a nozzle is found using the nozzle state check pattern shown in FIG. 14.
Figure 17:
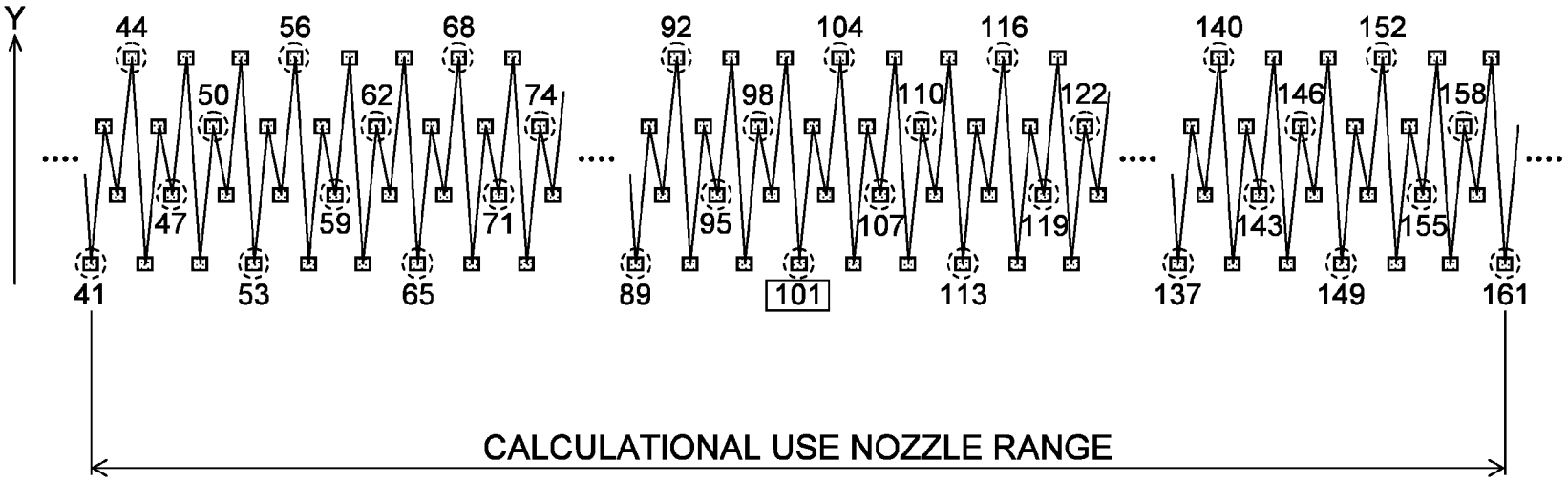
FIG. 17 is an explanatory illustration showing an example of a nozzle range of nozzles used for calculation used for calculation for finding the deposit displacement amount.

FIG. 16 and FIG. 17 each show a concrete example. As an example, considered is a case of finding the deposit displacement amount of the nozzle number n=101 in the inkjet head 100 which has the nozzle array with the number of the nozzle rows $N_r$=4 shown in FIG. 4. The nozzle state check pattern 130A shown in FIG. 16 is the division pattern illustrated in FIG. 14 with the regular pitch of the number of divisions k=3.

In this case, the nozzle numbers constituting the first tier may be represented by 3u+1, the nozzle numbers constituting the second tier by 3u+2, and the nozzle numbers constituting the third tier by 3u+3. The character u represents an integer equal to or more than 0.

In FIG. 16, a line designated by the numeral [101] is a line recorded by a nozzle of the nozzle number 101. As shown in FIG. 16, the line recorded by the nozzle number 101 in the nozzle state check pattern 130A belongs to the line group of the second tier.

In a case of calculating the deposit displacement amount of the nozzle number 101, 20 nozzles respectively on both sides of the nozzle number 101, that is, 40 nozzles in total are used, of the nozzles constituting the line group of the same second tier. Representing by the nozzle number, 40 nozzles in total of the nozzle numbers 41, 44, . . . , 98 and the nozzle numbers 104, 107, . . . , 161 are used. In other words, a set of the nozzle numbers of the nozzles used for calculation used for calculation for finding the deposit displacement amount of the nozzle number 101 is represented as below.

$$\text{Nozzle number}=\{3u+2\},\ \text{where } 13\leq u\leq 53,\ u\neq 33$$

In FIG. 16, an area of the nozzle state check pattern 130A where lines exist which are recorded respectively by 40 nozzles used for calculation for finding the deposit displacement amount is illustrated as a "deposit displacement amount calculation range".

On the other hand, a nozzle range where the nozzles used for calculation exist is a range of the nozzle numbers 41 to 161. The number of the all nozzles existing in this nozzle range is 120 except for the nozzle number 101.

FIG. 17 is an explanatory illustration showing the nozzle range of the calculation use nozzles. An illustration way in FIG. 17 is similar to FIG. 4 and FIG. 15. FIG. 17 shows, as the nozzle range of the nozzles used for calculation used for calculation for finding the deposit displacement amount of the nozzle number 101, a range of the nozzle numbers 41 to 161. The nozzle range of the nozzles used for calculation is represented as "nozzle range of nozzles used for calculation".

A set of 40 nozzles used for calculation includes 10 first row nozzles, 10 second row nozzles, 10 third row nozzles, and 10 fourth row nozzles.

On the other hand, a set of 120 nozzles existing in the nozzle range of the nozzles used for calculation includes 30 first row nozzles, 30 second row nozzles, 30 third row nozzles, and 30 fourth row nozzles. Therefore, the center of gravity of these 120 nozzles in Y direction is equal to the center of gravity of 40 nozzles in the Y direction. That is, Formula (9) is met. The numeral "40" of 40 nozzles is an example of "$N_A$" and the numeral "120" of 120 nozzles is an example of "$N_B$".

The nozzle state check pattern 130A illustrated in FIG. 14 and FIG. 16 meets Formula (9) for any nozzle number n.

This allows the deposit displacement amount of each nozzle to be accurately found even in the case where the inkjet head is attached with having the angle deviation.

The condition of Formula (9) is not limited to the above described embodiment, and can be extended and applied to a combination of various nozzle array forms and nozzle state check pattern forms. By meeting at least the condition of Formula (9), more preferably meeting both the conditions of Formula (9) and Formula (10), the above described problem can be solved.

The inkjet print device 10 according to the embodiment prints the nozzle state check pattern for which Formula (9) holds, uses a value of the deposit displacement amount analyzed from the read image of the nozzle state check pattern, and determines a nozzle having the large deposit displacement amount to be "abnormal". Then, the defective nozzle determined to be "abnormal" is not used for printing, and ejection amounts from the nozzles of the nozzle numbers which are on both side of the nozzle number of the defective nozzle are adequately increased to enable the streak to be indistinct. The correction process like this is referred to as a "non-ejection correction".

Further, after the deposit displacement amounts of the nozzles are calculated from the tiers in the nozzle state check pattern, as for the pixel pitch (distance between the adjacent pixels $P_i$) found by merging that data, the ejection amount where $P_i$ is smaller may be decreased and the ejection amount where $P_i$ is larger may be increased to reduce visibility of the streak. The correction process like this is referred to as a "printing density unevenness correction". Note that the pixel pitch $P_i$ is calculated using Formula (2).

If the number of the adjacent nozzles where $P_i$ is determined to be abnormal is increased, head maintenance is performed such that the ejection performance can be recovered and a clean printed imaged can be obtained. The head maintenance is also referred to as head cleaning. The head maintenance may include at least one of sucking the nozzle, auxiliary ejection, and wiping the nozzle surface, for example. The process inducing (migrating) to the head maintenance mode is referred to "maintenance inducement".

[Calculational Error]

Here, a calculational error is mentioned. As described in the above example, in consideration of the case where the approximate curve used for calculating the deposit displacement amount is created from the measured data of 40 lines, for example, contribution to the approximate curve is about 2.5% on average per one line. If the number of the nozzles used for calculation is set to a proper value such as around 40, there may be almost ignored in which nozzle row in the nozzle array the nozzle used in creating the approximate curve is, an influence of no-ejecting nozzle or ejection bending nozzle of which the ejection direction is largely bent (basically, influence of variations likely to irregularly occur) and the like.

Even if the no-ejecting nozzle or the ejection bending nozzle of which the ejection direction is largely bent is about ¼ of the total (10 nozzles of 40 nozzles) and these defective nozzles all exist disproportionately in a certain nozzle row in the nozzle array in a matrix, its influence to the calculation is merely about 25% and an extremely excellent result is given as compared with a case of not using invention (particularly, a case where a moving direction is made opposite to the actual moving due to the head rotation).

In conclusion, there is no problem even if, of the nozzles used for calculation creating the approximate curve, about 25% is the defective nozzles incapable of being used for calculation or is actually eliminated from the calculation. Discussed is that this way of thinking is alternatively used to an error in the coordinates of the center of gravity of the nozzle.

Figure 18B:
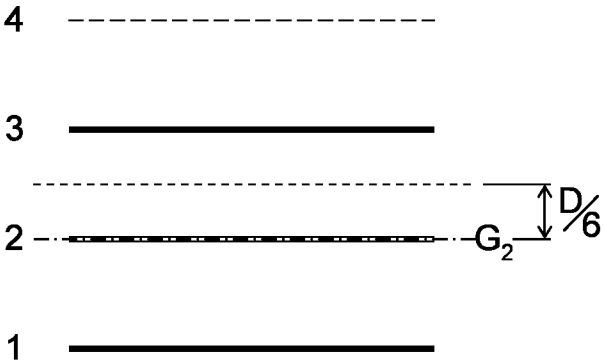
FIG. 18B is an explanatory illustration of the position of the center of gravity in the Y direction in a case where every nozzle in the fourth row is a no-ejecting nozzle.
Figure 18A:
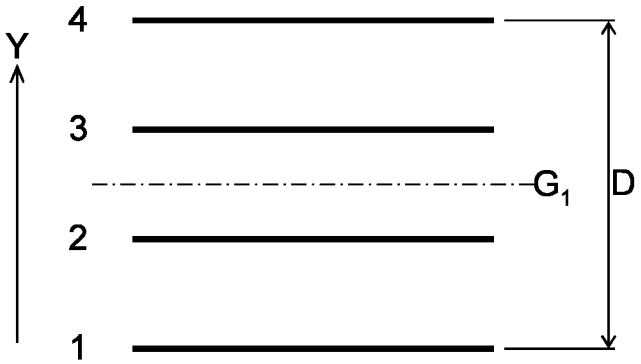
FIG. 18A is an explanatory illustration of a position of the center of gravity in a Y direction in the nozzle array in FIG. 4.

FIG. 18A is an explanatory illustration of the center of gravity in the Y direction in the nozzle array with the number of the nozzle rows Nr=4. A vertical direction in FIG. 18A is the Y-axis, and four lines in the figure schematically represent the Y coordinates of the first row nozzles, the Y coordinates of the second row nozzles, the Y coordinates of the third row nozzles, and the Y coordinates of the fourth row nozzles. Numerals on the left sides of the lines each represent the row number of the nozzle row. A distance in the Y direction from the nozzle row on one end (first row) to the nozzle row on the other end (fourth row) is designated by D. The distance D represents a range in the Y direction in nozzle array where the nozzle exits.

The position of the center of gravity in the Y direction in the case where the nozzles in the nozzle rows from the first row nozzles to the fourth row nozzles are evenly included in the calculation range for finding the approximate curve is a position in the middle of the second row nozzles and the third row nozzles as is designated by $G_1$ in FIG. 18A.

FIG. 18B shows a case where the all fourth row nozzles are the no-ejecting nozzles as an isolated case. In this case, any fourth row nozzle is not included in the nozzles used for calculating the approximate curve, and the nozzles used for calculating the approximate curve include only the first row nozzles, the second row nozzles, and the third row nozzles. In the case shown in FIG. 18B, as is designated by $G_2$, the position of the second row nozzles is the position of the center of gravity of the nozzles used for calculating the approximate curve.

The case shown in FIG. 18B is a case where ¼ of the total nozzles are the no-ejecting nozzles with respect to the state in FIG. 18A, and these no-ejecting nozzles exist disproportionately in a certain nozzle row (fourth row), and thus, the calculational error for the approximate curve is 25%.

The position $G_2$ of the center of gravity shown in FIG. 18B is moved from the position $G_1$ of the center of gravity shown in FIG. 18A by a distance D/6 in the Y direction. In other words, the position of the center of gravity of the nozzles is moved by about 20% of the distance D of the Y direction. The numeral ⅙ is about 17% represented in percentage, and thus, is rounded to be "about 20%".

Even in an isolate case where the no-ejecting nozzle or the nozzle of which the ejection direction is largely bent exists disproportionately in a certain nozzle row, the illustration in FIG. 18B may hold. FIG. 18B shows an extremely isolated case, which is, however, valid in consideration of the error permissible range.

In other word, if the moving of the coordinates of the center of gravity is within 20% of the distance D which is from the nozzle row on one end in the Y direction to the nozzle row on the other end, the error is perceived to fall within the range of the permissible error.

Regarding the condition described in Formula (9), a difference between the center of gravity of the nozzles used for calculation used for calculation for finding the deposit displacement amount and the center of gravity of all nozzles existing in the nozzle range of the nozzles used for calculation may be a deviation of 20% of the distance D that is the nozzle existing range in the Y direction. A case where a difference between a right side of Formula (9) and a left side of Formula (9) is within 20% of the distance D may be dealt with as the both are "equal".

[Moving Amount of Nozzle in X Direction with Respect to θz Rotation]

Here, a description is given of the reason why the moving amount of the nozzle in the X direction with respect to the θz rotation largely depends on the Y coordinates of that nozzle. Assume a case where an origin of nozzle coordinates is adequately defined, and coordinates of a certain nozzle ($x_i$, $y_i$) are rotated about the origin by an angle $\theta_r$.

If the inkjet head is calculatedly rotated by a certain angle $\theta_r$, how distance the nozzle moves can be calculated. Assuming when the nozzle at the certain nozzle coordinates ($x_i$, $y_i$) is rotated about the origin by the angle $\theta_r$, the nozzle is moved to a point ($x_{iA}$, $y_{iA}$), the X coordinate of the nozzle position after moving is represented by Formula (11).

$$x_{iA}=x_i\times\cos\theta_r-y_i\times\sin\theta_r \qquad \text{Formula (11)}$$

Here, $\theta_r$ is a value as small as an order of $10^{-3}$ radian, and accordingly, Formula (12) and Formula (13) each hold as an approximation formula.

$$\cos\theta_r\approx 1-\theta_r^2/2 \qquad \text{Formula (12)}$$

$$\sin\theta_r\approx\theta_r \qquad \text{Formula (13)}$$

Accordingly, a moving amount Δx_i for each nozzle in the X direction can be calculated as below by use of Formula (11), Formula (12), and Formula (13).

$$\begin{aligned}\Delta x_i &= x_{iA}-x_i \qquad \text{Formula (14)}\\ &= x_i(\cos\theta_r-1)-y_i\times\sin\theta_r\\ &\approx x_i(1-\theta_r^2/2-1)-y_i\times\theta_r\\ &= -x_i\times\theta_r^2/2-Y_i\times\theta_r\end{aligned}$$

In the embodiment, the first term on a right side of Formula (14) can be ignored. There are two reasons for that. A first reason is that, in the case of the embodiment, since the nozzles existing in a small area in the X direction are used to consider the relative positional displacement amount, an influence due to $x_i$ is cancelled. A second reason is that the first term on the right side of Formula (14) squaring $\theta_r$ is three orders of magnitude less than the second term in a state where $\theta_r$ is of the order of $10^{-3}$ radian.

Therefore, Formula (14) can be rewritten as Formula (15).

$$\Delta x_i=-y_i\times\theta_r \qquad \text{Formula (15)}$$

That is, the moving amount of the nozzle in the X direction with respect to the θz rotation approximately depends on only the coordinate in the Y direction.

[Inkjet Head Ejection Performance Evaluation Method]

Figure 19:
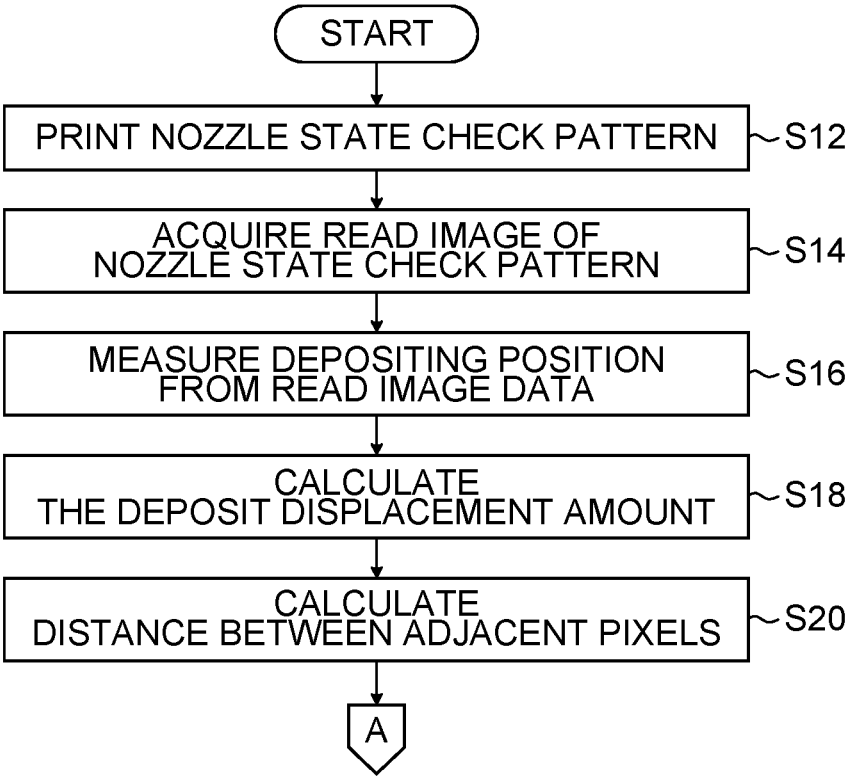
FIG. 19 is a flowchart showing a procedure of an inkjet head ejection performance evaluation method according to the embodiment.

FIG. 19 is a flowchart showing a procedure of an inkjet head ejection performance evaluation method according to the embodiment. The flowchart in FIG. 19 describes operations implemented by a control program or calculation processing function in a control apparatus of inkjet print device 10.

The inkjet head ejection performance evaluation method includes a step of printing the nozzle state check pattern (step S12), a step of acquiring the read image of the nozzle state check pattern (step S14), a step of measuring the depositing position from the read image data (step S16), a step of calculating the deposit displacement amount based on the measurement result in step S16 (step S18), and a step of calculating the distance between the adjacent pixels based on information of the deposit displacement amount found in step S18 (step S20).

The nozzle state check pattern printing step at step S12 corresponds to an aspect of a "test pattern outputting step". The nozzle state check pattern printed in step S12 is, for example, a division pattern with a regular pitch having plural divided tiers of the number of divisions k, such as a the nozzle state check pattern 130A illustrated in FIG. 14, in which the number of the nozzle rows $N_r$ is coprime to the number of divisions k.

In the read image acquiring step at step S14, the printed result of the nozzle state check pattern is read by the inline sensor 58 to take in the read image data. Step S14 corresponds to an aspect of an "image reading step".

The depositing position measuring at step S16 corresponds to an aspect of a "first calculation step". At step S16, as illustrated in FIG. 7, the line position of each line is measured for each tier in the division pattern. The line position measured at step S16 corresponds to an aspect of a "first depositing position".

The deposit displacement amount calculating step at step S18 is a step of finding the deposit displacement amount for each nozzle based on the depositing position found in the depositing position measuring step at step S16 and pattern information concerning the nozzle state check pattern. The pattern information of the nozzle state check pattern includes information concerning the number of divisions (the number of the tiers) or the nozzle interval in the line group of each tier. The pattern information of the nozzle state check pattern may include information identifying the nozzle number of the nozzle recording each line, that is, information specifying a correspondence relationship between each line and the nozzle number.

The deposit displacement amount calculating step at step S18 corresponds to an aspect of a "second calculation step". A calculating method of the deposit displacement amount in the deposit displacement amount calculating step at step S18 is as already illustrated in FIG. 8, and such that the approximate curve is created from the measured data of the lines of 40 nozzles which belong to the line group of the same tire as the nozzle of interest whose deposit displacement amount is to be found, and the deposit displacement amount is found from the depositing positions of this approximate curve and nozzle of interest.

The nozzle whose deposit displacement amount is found by the deposit displacement amount calculating step at step S18 may be all nozzles in the inkjet head 100 or a part of the nozzles. In this example, the deposit displacement amounts of all nozzles in the inkjet head are respectively found. Concretely, considering by use of the first tier in FIG. 14, the deposit displacement amounts of the nozzles can be found as $d_1$, $d_4$, $d_7$ . . . and so on.

The distance-between-adjacent pixels calculating step at step S20 is a step of merging the calculation result in step S18 to calculate the distance between the adjacent pixels. The step S20 corresponds to an aspect of a "third calculation step". In the distance-between-adjacent pixels calculating step at step S20, a distance between the pixels of the adjacent nozzle numbers (distance between the adjacent pixels) is found in accordance with Formula (2) already described. After step S20 in FIG. 19, the process goes to step S30 in FIG. 20.

At step S30, presence or absence of abnormality is determined based on the calculation result in step S20. In other words, whether the distance between the adjacent pixels $P_i$ found at step S20 is normal or abnormal is determined in a method as described in [Determination method to be normal or abnormal] set forth above. Then, if abnormality is determined, further, the defective nozzle is identified.

If the abnormality is determined at step S30, at subsequent step S32 in determination on abnormality, Yes is true, and the process goes to step S34. At step S34, whether or not the head maintenance is needed is determined. The determination on whether or not the head maintenance is needed is made in accordance with a prescribed determination criteria defined in advance. For example, if the number of portions where the distance between the adjacent pixels $P_i$ is determined to be abnormal increases to exceed a prescribed amount, the head maintenance is needed.

At step S34, if the head maintenance is determined to not be needed, the process goes to step S36. At step S36, ejection disabling process for the defective nozzle is performed. The ejection disabling process is a process of forcibly making the defective nozzle unusable (disabling from ejection) so that the defective nozzle is not used for printing.

Further, in order to supplement the image defection involved by disabling the defective nozzle from ejection at step S36, a correction process is performed at step S38 using the near nozzles around the defective nozzle. The correction process at step S38 is a correction process of making the streak which is generated by disabling the defective nozzle from ejection to be indistinct, in which ink ejection amounts from the near nozzles are modified such that the near nozzles around the defective nozzle are made to carry out the droplet ejection in place of the defective nozzle.

At step S34, if the head maintenance is determined to be needed, the process goes to step S40 to carry out the head maintenance.

If No determination is made at step S32, the processes from step S34 to step S40 are skipped to end this flowchart. In addition, when the process at step S38 or the process at step S40 ends, this flowchart ends.

[Description of Controlling System in Inkjet Print Device 10]

Figure 21:
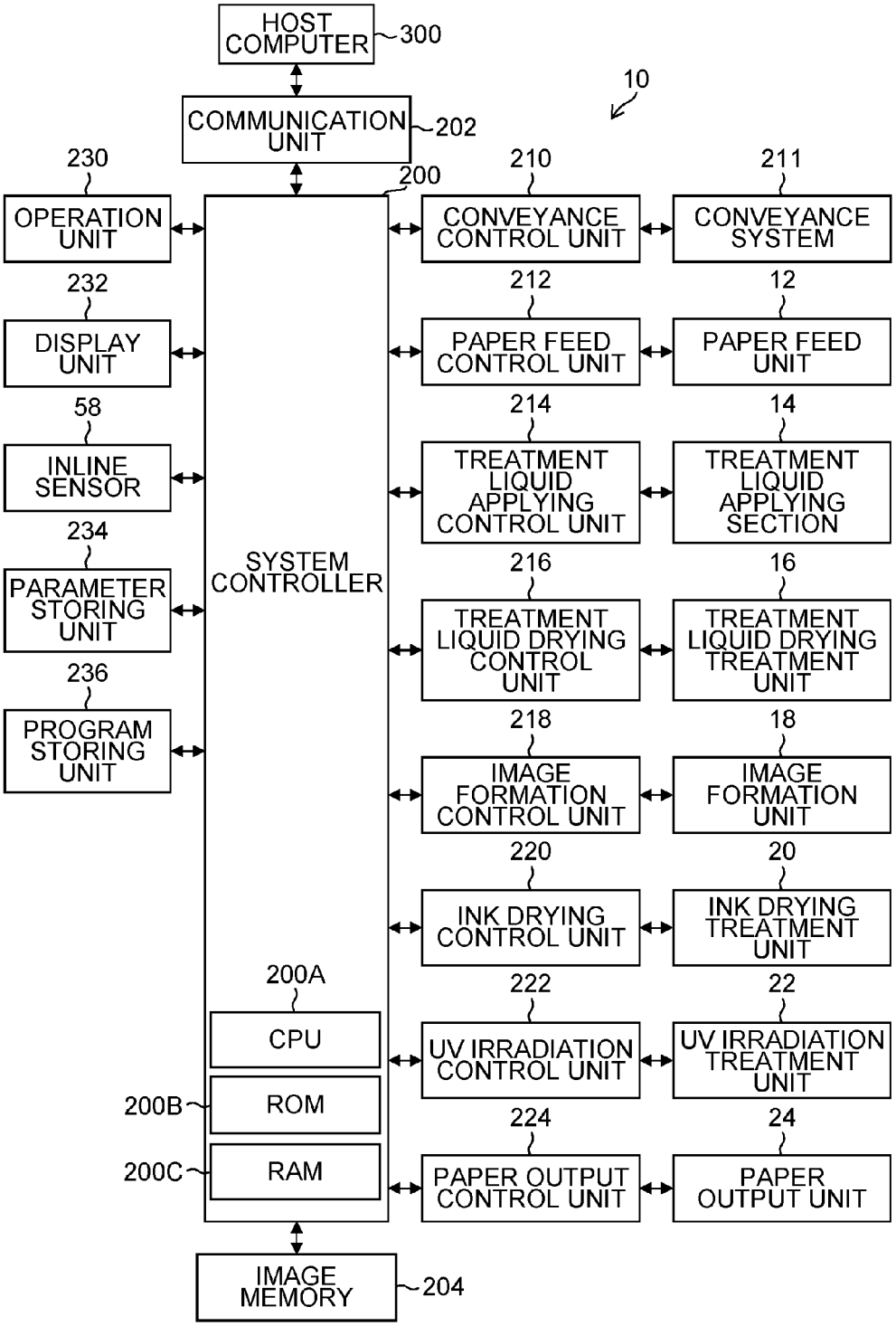
FIG. 21 is a block diagram showing a configuration of a controlling system in the inkjet print device.

FIG. 21 is a block diagram showing a configuration of a controlling system in the inkjet print device 10. The inkjet print device 10 includes a system controller 200, a communication unit 202, an image memory 204, a conveyance control unit 210, a paper feed control unit 212, a treatment liquid applying control unit 214, a treatment liquid drying control unit 216, an image formation control unit 218, an ink drying control unit 220, a UV irradiation control unit 222, a paper output control unit 224, an operation unit 230, and a display unit 232.

The system controller 200, which is a control apparatus in the inkjet print device 10, functions as a controlling device which collectively controls the units in the inkjet print device 10 and functions as a calculation device performing various calculation processes. This system controller 200 has built in a CPU (Central Processing Unit) 200A, a ROM (Read Only Memory) 200B, and a RAM (Random Access Memory) 200C. The memory such as the ROM 200B and the RAM 200C may be provided outside the system controller 200.

The communication unit 202 includes a given communication interface, and transmits and receives data to and from a host computer 300 connected with the communication interface.

The image memory 204 functions as a transitory storage device for various pieces of data including the image data, from and into which image memory the data is read and written via the system controller 200. The image data taken in via the communication unit 202 from the host computer 300 is stored once in the image memory 204.

The conveyance control unit 210 controls an operation of a conveyance system 211 for the recording medium 28 in the inkjet print device 10 (conveyance of the recording medium 28 from the paper feed unit 12 to the paper output unit 24). The conveyance system 211 includes the treatment liquid applying drum 42 in the treatment liquid applying section 14, the treatment liquid drying drum 46 in the treatment liquid drying treatment unit 16, the image forming drum 52 in the image formation unit 18, and the chain gripper 64 which are illustrated in FIG. 1 (see FIG. 1).

The paper feed control unit 212 controls, in response to an instruction from the system controller 200, operations of the units in the paper feed unit 12 such as drive of the paper feed roller pair 34, and drive of the tape feeder 36A.

The treatment liquid applying control unit 214 controls, in response to an instruction from the system controller 200, operations of the units in the treatment liquid applying section 14 such as an operation of the treatment liquid applying unit 44 (application amount of the treatment liquid, the application timing and the like).

The treatment liquid drying control unit 216 controls, in response to an instruction from the system controller 200, operations of the units in the treatment liquid drying treatment unit 16. In other words, the treatment liquid drying control unit 216 controls operations of the treatment liquid drying treatment unit 50 such as a drying temperature, a flow rate of a dried gas, and an injection timing of the dried gas (see FIG. 1).

The image formation control unit 218 controls, in response to an instruction from the system controller 200, the ink ejection from the head units 56C, 56M, 56Y, and 56K in the image formation unit 18 (see FIG. 1).

The image formation control unit 218 is configured to include an image processing unit (not shown) forming dot data from input image data, a waveform generating unit (not shown) generating a waveform of a drive voltage, a waveform storing unit (not shown) storing the waveform of the drive voltage, and a drive circuit (not shown) supplying to each of the head units 56C, 56M, 56Y, and 56K a drive voltage having a drive waveform depending on the dot data.

The image processing unit subjects the input image data to a color separation process of separating into each color of RGB, a color conversion process of converting RGB into CMYK, a correction process such as gamma correction and unevenness correction, and a half-tone process of converting continuous tone data of each color into binary or multivalued dot data of each color.

The droplet ejection timing and ink droplets deposition amount at each pixel position are determined based on the dot data generated through the process by the image processing unit, the drive voltage and a drive signal (control signal determining the droplet ejection timing for each pixel) are generated depending on the droplet ejection timing and ink droplets deposition amount at each pixel position, this drive voltage is supplied to the head units 56C, 56M, 56Y, and 56K, and a dot is formed at each pixel position by an ink droplet ejected from each of the head units 56C, 56M, 56Y, and 56K.

The ink drying control unit 220 controls, in response to an instruction from the system controller 200, an operation of the ink drying treatment unit 20. In other words, the ink drying control unit 220 controls operations of the ink drying treatment unit 68 such as the drying temperature, the flow rate of a dried gas, and the injection timing of the dried gas (see FIG. 1).

The UV irradiation control unit 222 controls, in response to an instruction from the system controller 200, a light quantity of the ultraviolet rays (irradiation energy) from the UV irradiation treatment unit 22 and an irradiation timing of the ultraviolet rays.

The paper output control unit 224 controls, in response to an instruction from the system controller 200, an operation of the paper output unit 24 to stack the recording medium 28 on the paper output platform 76 (see FIG. 1).

The operation unit 230 includes an operational member such as an operation button, a keyboard and a touch panel, and transmits operational information input from the operational member to the system controller 200. The system controller 200 performs various processes in response to the operational information transmitted from the operation unit 230.

The display unit 232 includes a display device such as a liquid crystal panel, and displays, in response to an instruction from the system controller 200, information such as various pieces of setting information concerning the devices and abnormality information on the display device.

Detection signals (detected data) output from the inline sensor 58 are subjected to a process such as denoising and waveform shaping, and stored via the system controller 200 in a predetermined memory (e.g., RAM 200C).

A parameter storing unit 234 is a device storing therein various parameters used by the inkjet print device 10. The various parameters stored in the parameter storing unit 234 are read via the system controller 200 to be set for the units in the device 10.

A program storing unit 236 is a device storing therein programs which are used by the units in the inkjet print device 10. The various programs stored in the program storing unit 236 are read via the system controller 200 to be executed in the units in the device 10.

Figure 22:
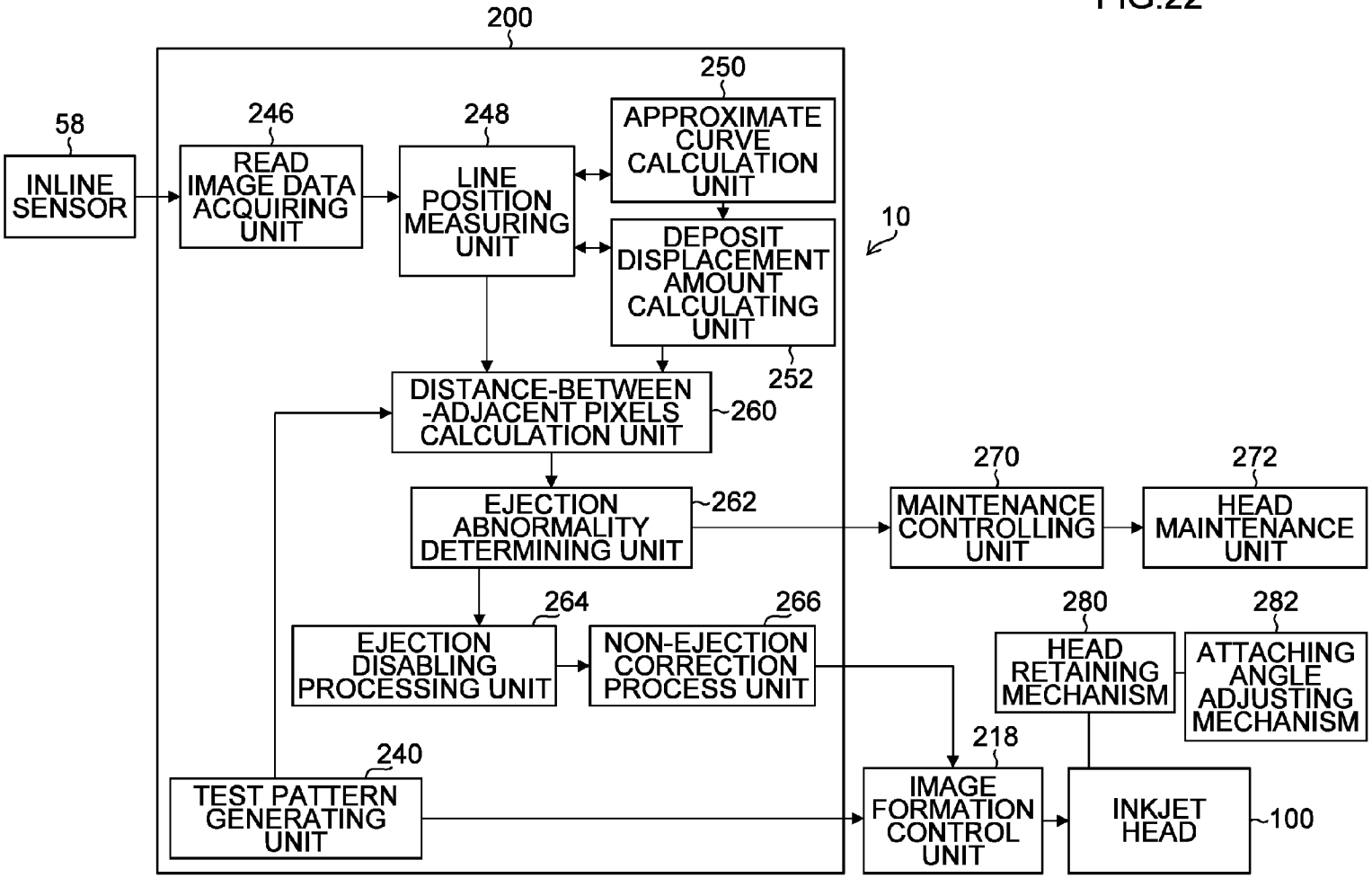
FIG. 22 is a block diagram showing a main part configuration of the controlling system in the inkjet print device.

FIG. 22 is a block diagram showing a main part of the controlling system in the inkjet print device according to the embodiment. In FIG. 22, the same component as in the configuration previously illustrated in FIG. 21 is designated by the same reference numeral, and the description thereof is omitted.

As shown in FIG. 22, the inkjet print device 10 includes a test pattern generating unit 240, a read image data acquiring unit 246, a line position measuring unit 248, an approximate curve calculation unit 250, a deposit displacement amount calculating unit 252, an distance-between-adjacent pixels calculation unit 260, an ejection disabling processing unit 264, and a non-ejection correction process unit 266. Processing functions of these units (240 to 266) can be implemented in combination of hardware circuits of the system controller 200 and the programs.

The test pattern generating unit 240 generates printing data of the nozzle state check pattern and other test patterns. The test pattern generating unit 240 can supply the data of the nozzle state check pattern meeting the condition of Formula (9) to the image formation control unit 218. In the case where the inkjet head 100 has the nozzle array illustrated in FIG. 4, the nozzle state check pattern 130A illustrated in FIG. 14 is an example of the nozzle state check pattern meeting the condition of Formula (9). The data output from the test pattern generating unit 240 is transmitted to the image formation control unit 218 to control an ejection operation of the inkjet head 100 such that the nozzle state check pattern 130A is recorded on the recording medium 28. The test pattern generating unit 240 corresponds to an aspect of a "test pattern generating device". A combination of the test pattern generating unit 240 and the image formation control unit 218 corresponds to an aspect of a "test pattern output control device".

The read image data acquiring unit 246 is an interface part acquiring the read image data from the inline sensor 58. The system controller 200 acquires the read image data via the read image data acquiring unit 246.

The line position measuring unit 248 analyzes the read image acquired via the read image data acquiring unit 246 to measure the line positions of the lines 160 for each tier (for each line group), as for the line group of each of the divided tiers in the nozzle state check pattern 130A. The line position measuring unit 248 performs the process of step S16 in FIG. 19. The line position measured by the line position measuring unit 248 corresponds to an aspect of the "first depositing position". The line position measuring unit 248 corresponds to an aspect of a "first calculation device".

The approximate curve calculation unit 250 carries out calculation for finding the approximate curve based on the pattern information of the nozzle state check pattern and data of the line position. The approximate curve calculation unit 250 carries out calculation for finding the approximate curve from data of the measured line position (measured data of the line) for each of the divided tiers (line group) in the nozzle state check pattern 130. The approximate curve calculation unit 250 corresponds to an aspect of an "approximate curve calculation device".

The deposit displacement amount calculating unit 252 calculates the deposit displacement amount from the approximate curve found by the approximate curve calculation unit 250 and the data of the line position measured by the line position measuring unit 248. The deposit displacement amount calculating unit 252 performs the process of step S18 in FIG. 19 in collaboration with the approximate curve calculation unit 250. A combination of the approximate curve calculation unit 250 and the deposit displacement amount calculating unit 252 corresponds to an aspect of a "second calculation device".

The distance-between-adjacent pixels calculation unit 260 performs the process of step S20 in FIG. 19. The distance-between-adjacent pixels calculation unit 260 merges the information of the deposit displacement amounts of the nozzles which are found by the deposit displacement amount calculating unit 252 and uses the pattern information of the nozzle state check pattern to calculates the distance between the adjacent pixels. The distance-between-adjacent pixels calculation unit 260 corresponds to an aspect of a "third calculation device".

Figure 20:
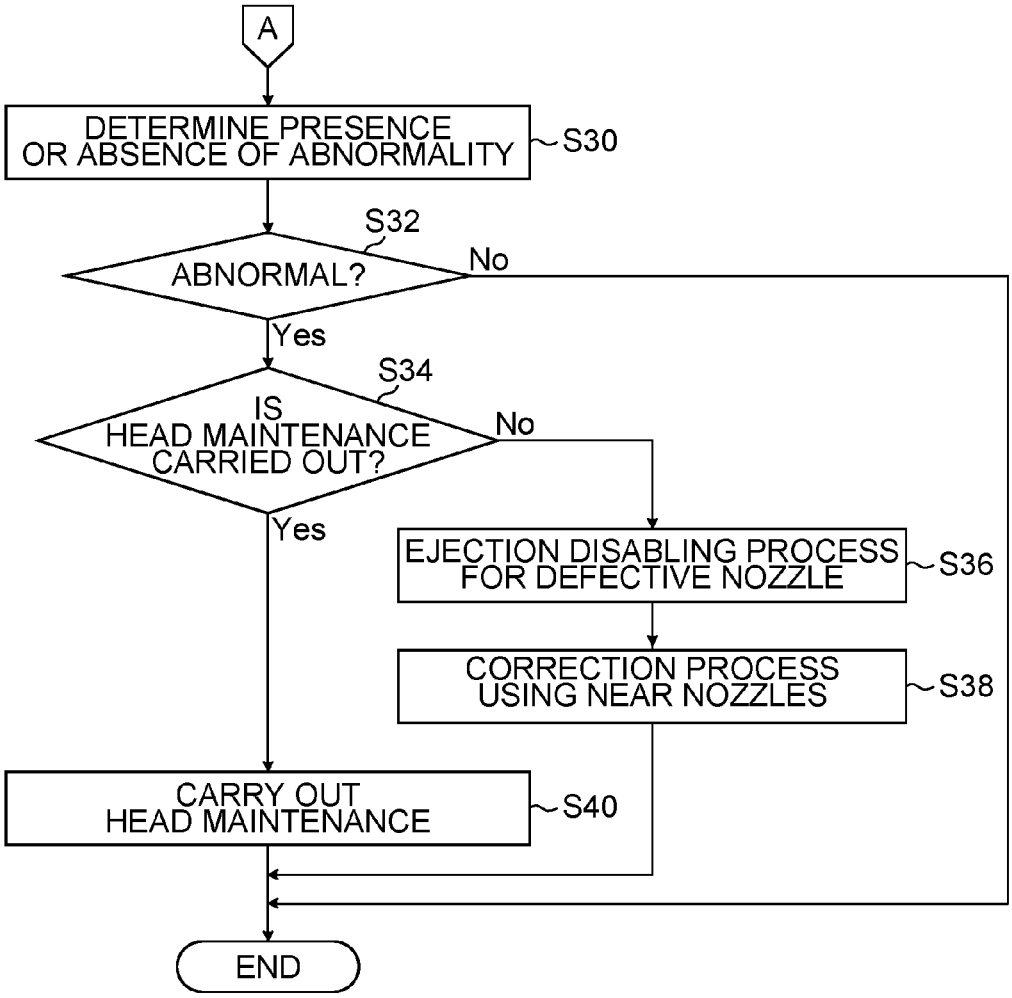
FIG. 20 is a flowchart showing a procedure of the inkjet head ejection performance evaluation method according to the embodiment.

An ejection abnormality determining unit 262 performs the process of steps S30 to S34 in FIG. 20. The ejection abnormality determining unit 262 corresponds to an aspect of a "determining device".

The ejection disabling processing unit 264 performs the process of step S36 FIG. 20. The ejection disabling processing unit 264 performs the ejection disabling process of disabling the defective nozzle from ejection, for which defective nozzle the distance between the adjacent pixels found by the distance-between-adjacent pixels calculation unit 260 is out of a prescribed acceptable range. Further, the ejection disabling processing unit 264 may be in a form of performing the ejection disabling process of disabling the defective nozzle from ejection, the deposit displacement amount for each nozzle of which defective nozzle exceeds a threshold. The ejection disabling processing unit 264 corresponds to an aspect of an "ejection disabling processing device".

The non-ejection correction process unit 266 performs the process of step S38 in FIG. 20. The non-ejection correction process unit 266 performs an image correcting process such that the image defection (the streak) involved by disabling the defective nozzle from ejection is made to be indistinct by use of the near nozzles around the defective nozzle. The non-ejection correction process unit 266 corresponds to an aspect of a "correction processing device".

The inkjet print device 10 includes a maintenance controlling unit 270 and a head maintenance unit 272. The maintenance controlling unit 270 controls an operation of the head maintenance. The head maintenance unit 272 may be configured to include a cleaning device wiping the nozzle surface 102 of the inkjet head 100 and a sucking device sucking the ink within the nozzles 110. The maintenance controlling unit 270 performs the process of step S40 in FIG. 20.

The inkjet print device 10 also includes a head retaining mechanism 280 and an attaching angle adjusting mechanism 282. The head retaining mechanism 280 is a retaining device which retains the inkjet head 100 at the print position where to face the image forming drum 52. The inkjet head 100 is retained at a predetermined attaching angle by the head retaining mechanism 280. The head retaining mechanism 280 is provided with the attaching angle adjusting mechanism 282 for adjusting the attaching angle of the inkjet head 100. The attaching angle adjusting mechanism 282 may be provided to the inkjet heads 100 constituting the head unit 56 or as an adjusting device which adjusts the attaching angle of the head unit 56, or a combination of these.

[Ejection Method]

Although a detailed configuration of the inkjet head 100 is not shown, an ejector in the inkjet head 100 is configured to include the nozzle 110 ejecting a liquid, a pressure chamber communicating with the nozzle 110, and an ejection energy generating element giving the liquid within the pressure chamber an ejection energy. In the ejection method for ejecting the liquid droplets from the nozzle 110 in the ejector, a generating device which generates the ejection energy is not limited to a piezo element, and various ejection energy generating elements may be used such as a heater element or a static actuator. For example, a method may be used in which a pressure of film boiling by way of heating the liquid by the heater element is used to eject the liquid droplets. A corresponding ejection energy generating element is provided in a flow channel structure in accordance with the ejection method of the inkjet head.

[Nozzle Array]

The nozzle array form of the inkjet head 100 is not limited to the form illustrated in FIG. 3 and FIG. 4, and various array forms may be used. The inkjet head 100 may be configured to have a nozzle array in a matrix in which the plural nozzles are arrayed in two or more alignments in the Y direction that is a direction of the relative movement.

The above description is given of one inkjet head 100 constituting the head unit 56, but the description of the inkjet head 100 can be similarly applied to the nozzle array of the entire head unit 56.

Second Embodiment

The first embodiment describes the case where the lines in a certain tier in the nozzle state check pattern are aligned at the regular pitch, but the preferable condition is that Formula (9) is met, or Formula (9) and Formula (10) are met if possible, similarly, even in a case where the lines are not aligned at the regular pitch, that is, are aligned at an irregular pitch, in order to calculate including accurately the influence due to θz.

The irregular pitch means, for example, a case where regarding the nozzle numbers in the nozzle array in FIG. 4, the nozzle interval is an irregular interval such that the nozzle numbers of the nozzles which record the lines constituting the line group of a certain tier in the nozzle state check pattern are 2, 5, 7, 10, 12, 14, 18, 21, 25 and so on.

As for the nozzles aligned irregularly like this, the center of gravity a certain nozzle number n of which deposit displacement amount is wanted to be found can be calculated by Formula (5) and Formula (6), and the center of gravity of all nozzles existing in the nozzle range of the nozzles used for calculation which are used for calculation for finding the deposit displacement amount can be calculated by Formula (7) and Formula (8).

Advantage of Embodiments

According to the embodiments of the present invention, the ejection condition of each nozzle can be evaluated accurately including the influence due to the angle deviation of the inkjet head. This makes it possible to perform the high accurate abnormality determination and correction process.

Modification Example 1

The nozzle state check pattern 130A illustrated in FIG. 14 has the number of divisions k=3 equal to the total number of tiers of the division pattern. The nozzle state check pattern having the number of divisions equal to the total number of tiers like this is the simplest configuration, and is advantageous in that a space (paper plane area) required for recording the nozzle state check pattern on the recording medium cam be decreased.

However, in implementing the invention, the total number of tiers of the test pattern may not be necessarily configured to be equal to the number of divisions. Additionally, the lines recorded by the same nozzle may be included in the line groups of the different tiers. For example, a tier of redundant line group may be configured to be added in order to improve the accuracy of the calculation. Moreover, a test pattern may be used in a combination of the tier of the line group with the regular pitch and the tier of the line group with the irregular pitch. For example, a configuration may be used in which one tier is a line group with the regular pitch, and another tier includes a line group with the regular pitch and another line (redundant line) added.

Modification Example 2

The embodiment described above shows the configuration in which the recording medium is conveyed with respect to the stopped inkjet head to cause the relative movement between the inkjet head and the recording medium, but in implementing the present invention, the inkjet head may be configured to be moved with respect to the stopped recording medium. Note that the single-pass printing full-line type heads are usually arranged along a direction perpendicular to the conveying direction of the recording medium, but the inkjet heads may be arranged along an inclined direction at an angle to the direction perpendicular to the conveying direction in an aspect.

The embodiment described above shows an example of the full-line type inkjet print device 10, but in implementing the present invention, may be applied to an inkjet print device with a serial head in which print is performed on an entire surface of the recording medium by repeating such a series of operations that a shorter length head not reaching the width of the recording medium is made to scan in the width direction of the recording medium for printing in the same direction, the recording medium is moved by a certain amount, and the next area is printed in the width direction of the recording medium.

In a case where the inkjet head carries out the reciprocating scanning in this way to perform print, a carriage moving the inkjet head corresponds to an aspect of a "relative moving device" and a moving direction (scanning direction) of the inkjet head corresponds to the "Y direction".

Combination of Controlling Examples

The configuration described in the above embodiments or the matter described in the modification example may be appropriately combined to be used and a part of the matters may be replaced.

[Conveyance Device for Recording Medium]

A conveyance device which conveys the recording medium 28 is not limited to the drum conveyance method illustrated in FIG. 1, and various forms may be used such at a belt conveyance method, a nip conveyance method, a chain conveyance method, and a pallet conveyance method, and these methods may be combined.

[Terms]

The term "perpendicular" or "vertical" herein includes, of aspects of crossing at an angle less than 90° or more than 90°, an aspect of generating an action and effect the same as a case of crossing at substantially an angle 90°.

The term "recording medium" means a "medium" used for printing. The recording medium is equivalent to terms such as a print paper sheet, a recording paper sheet, a paper sheet, a printing medium, a printed medium, a recorded medium, an image formation medium, an image formed medium, an image receiving medium, and an ejection deposited medium. A material, shape or the like of the recording medium is not specifically limited, and a resin sheet, a film, fabric, a non-woven fabric and other materials may be used besides the paper material, and various foul's may be used such as a continuous paper, a cut sheet of paper sheet (cut paper sheet) and a seal paper sheet.

The term "image" is assumed to be widely construed, including a color image, a bitonal image, a single color image, a gradation image, and an even density (solid color) image. The term "image" is not limited to a photographed image, and is used as an encompassing tem, including a pictural design, a character, a sign, a drawing line, a mosaic pattern, a pattern differently colored, and other various patterns, or a combination of these. The term "print" includes a concept of terms such as typing print, recording an image, image formation, drawing, and printing.

The term "print device" is equivalent to terms such as printing machine, printer, image recording device, drawing device, and image formation device.

In the embodiments of the present invention described above, the configuration requirements may be appropriately changed, added or deleted without departing from the scope of the present invention. The present invention is not limited to the above described embodiments, but may be variously modified by a person having ordinary skill in the art within the technical idea of the present invention.

What is claimed is:

1. An inkjet print device comprising:

an inkjet head having a plurality of nozzles arrayed in a matrix;

a test pattern output control device configured to control the inkjet head to record a test pattern for examining an ejection condition for each of the nozzles on a recording medium;

an image reading device configured to optically read an image of the test pattern recorded on the recording medium;

a first calculation device configured to measure a depositing position for each of the nozzles from the image of the test pattern read by the image reading device; and a second calculation device configured to calculate a deposit displacement amount for each of the nozzles based on the depositing position measured by the first calculation device and pattern information of the test pattern, wherein the test pattern is a line pattern for recording a line for each of the nozzles in a Y direction, and is divided into two or more line groups in the Y direction to be recorded on the recording medium, where the Y direction is a direction of relative movement between the inkjet head and the recording medium, and a position of a center of gravity in the Y direction of $N_A$ nozzles used for calculation is equal to a position of a center of gravity in the Y direction of $N_B$ nozzles existing in a nozzle range of the nozzles used for calculation, where n is a nozzle number of a nozzle of which deposit displacement amount is calculated by the second calculation device, and $N_A$ is a number of the nozzles used for calculation that record lines used for calculation for calculating the deposit displacement amount of the nozzle of the nozzle number n, and $N_B$ is a number of all nozzles existing in the nozzle range of the $N_A$ nozzles used for calculation in a nozzle array in a matrix.

2. The inkjet print device according to claim 1, wherein $\Sigma_A y_i/N_A$ is equal to $\Sigma_B y_i/N_B$, where i is an integer representing a nozzle number identifying each nozzle in the nozzle array, $y_i$ is a Y coordinate representing a position of the nozzle of the nozzle number i in the Y direction, $\Sigma_A y_i$ is a sum of Y coordinates of the $N_A$ nozzles used for calculation, and $\Sigma_B y_i$ is a sum of Y coordinates of the $N_B$ nozzles existing in the nozzle range of the nozzles used for calculation.

3. The inkjet print device according to claim 1, wherein in a case where a difference between a position of a center of gravity in the Y direction of the $N_A$ nozzles used for calculation and a position of a center of gravity in the Y direction of the $N_B$ nozzles existing in a nozzle range of the nozzles used for calculation is within 20% of a distance in the Y direction of an area in which the nozzles exist in a nozzle array in a matrix, this case meets a condition that the position of the center of gravity in the Y direction of the $N_A$ nozzles used for calculation is equal to the position of the center of gravity in the Y direction of the $N_B$ nozzles existing in the nozzle range of the nozzles used for calculation.

4. The inkjet print device according to claim 1, further comprising a relative moving device configured to cause relative movement between the inkjet head and the recording medium, wherein the inkjet head has a nozzle array in which a plurality of nozzles are arrayed in two or more alignments in the Y direction.

5. The inkjet print device according to claim 1, wherein of the line groups in the test pattern, at least lines used for calculation for calculating the deposit displacement amount of the nozzle of the nozzle number n are aligned at a regular pitch of a number of divisions k, $N_r$ and k are respectively an integer equal to or more than 2, and $N_r$ is coprime to k, where $N_r$ is a number of alignments of the nozzles in the Y direction in the nozzle array.

6. The inkjet print device according to claim 1, further comprising a test pattern generating device configured to generate data of the test pattern, wherein the test pattern output control device controls ejection from the inkjet head based on the data of the test pattern.

7. The inkjet print device according to claim 1, wherein the first calculation device measures a position of the line which is the depositing position, for each of the divided line groups.

8. The inkjet print device according to claim 7, further comprising an approximate curve calculation device configured to calculate an approximate curve from data of the depositing position measured for each of the divided line groups, wherein the second calculation device calculates the deposit displacement amount from the approximate curve and the data of the depositing position.

9. The inkjet print device according to claim 8, wherein the nozzles used for calculation are the nozzles used for calculation for calculating the approximate curve, and the approximate curve is obtained based on measured data of $N_A$ lines recorded by the $N_A$ nozzles used for calculation.

10. The inkjet print device according to claim 1, further comprising a third calculation device configured to calculate a distance between adjacent pixels by using a calculation result by the second calculation device.

11. The inkjet print device according to claim 10, further comprising:

an ejection disabling processing device configured to disable a defective nozzle from ejection, the distance between the adjacent pixels calculated for the defective nozzle by the third calculation device being out of a prescribed acceptable range; and a correction processing device configured to perform image correction to supplement an image defection which is involved by disabling the defective nozzle from ejection by use of near nozzles around the defective nozzle.

12. The inkjet print device according to claim 1, further comprising:

an ejection disabling processing device configured to disable a defective nozzle from ejection, the deposit displacement amount of the defective nozzle calculated by the second calculation device exceeding a threshold, and a correction processing device configured to perform image correction to supplement an image defection which is involved by disabling the defective nozzle from ejection by use of near nozzles around the defective nozzle.

13. The inkjet print device according to claim 1, comprising a determining device configured to determine presence or absence of abnormality based on a calculation result by the second calculation device, wherein at least an operation of correction process or head maintenance is performed in a case where the determining device determines that ejection abnormality is present.

14. An inkjet head ejection performance evaluation method comprising:

a test pattern outputting step of, in an inkjet head having a plurality of nozzles arrayed in a matrix, recording a test pattern on a recording medium by the inkjet head, the test pattern being for examining an ejection condition for each of the nozzles;

an image reading step of optically reading an image of the test pattern recorded on the recording medium;

a first calculation step of measuring a depositing position for each of the nozzles from the image of the test pattern read in the image reading step; and a second calculation step of calculating a deposit displacement amount for each of the nozzles based on the depositing position measured in the first calculation step and pattern information of the test pattern, wherein the test pattern is a line pattern for recording a line for each of the nozzles in a Y direction, and is divided into two or more line groups in the Y direction to be recorded on the recording medium, where the Y direction is a direction of relative movement between the inkjet head and the recording medium, and a position of a center of gravity in the Y direction of $N_A$ nozzles used for calculation is equal to a position of a center of gravity in the Y direction of $N_B$ nozzles existing in a nozzle range of the nozzles used for calculation, where n is a nozzle number of a nozzle of which deposit displacement amount is calculated by the second calculation step, and $N_A$ is the number of nozzles used for calculation that record lines used for calculation for calculating the deposit displacement amount of the nozzle of the nozzle number n, and $N_B$ is a number of all nozzles existing in the nozzle range of the $N_A$ nozzles used for calculation in a nozzle array in a matrix.

* * * * *